US008791656B1

(12) United States Patent
Zwart et al.

(10) Patent No.: US 8,791,656 B1
(45) Date of Patent: Jul. 29, 2014

(54) ACTIVE RETURN SYSTEM

(71) Applicant: Mevion Medical Systems, Inc., Littleton, MA (US)

(72) Inventors: Gerrit Townsend Zwart, Durham, NH (US); James Cooley, Andover, MA (US)

(73) Assignee: Mevion Medical Systems, Inc., Littleton, MA (US)

( * ) Notice: Subject to any disclaimer, the term of this patent is extended or adjusted under 35 U.S.C. 154(b) by 0 days.

(21) Appl. No.: 13/907,601

(22) Filed: May 31, 2013

(51) Int. Cl.
*H05H 15/00* (2006.01)

(52) U.S. Cl.
USPC ..... 315/503; 315/500; 315/501; 315/502; 315/505; 315/507

(58) Field of Classification Search
None
See application file for complete search history.

(56) References Cited

U.S. PATENT DOCUMENTS

| | | | |
|---|---|---|---|
| 2,280,606 | A | 4/1942 | Van et al. |
| 2,492,324 | A | 12/1949 | Salisbury |
| 2,615,129 | A | 10/1952 | McMillan |
| 2,616,042 | A | 10/1952 | Weeks |
| 2,659,000 | A | 11/1953 | Salisbury |
| 2,701,304 | A | 2/1955 | Dickinson |
| 2,789,222 | A | 4/1957 | Martin |
| 3,175,131 | A | 3/1965 | Burleigh et al. |
| 3,432,721 | A | 3/1969 | Naydan et al. |
| 3,582,650 | A | 6/1971 | Avery |
| 3,679,899 | A | 7/1972 | Dimeff |
| 3,689,847 | A | 9/1972 | Verster |
| 3,757,118 | A | 9/1973 | Hodge et al. |
| 3,868,522 | A | 2/1975 | Bigham et al. |
| 3,886,367 | A | 5/1975 | Castle |
| 3,925,676 | A | 12/1975 | Bigham et al. |
| 2,958,327 | A | 5/1976 | Marancik et al. |
| 3,955,089 | A | 5/1976 | McIntyre et al. |
| 3,958,327 | A | 5/1976 | Marancik et al. |
| 3,992,625 | A | 11/1976 | Schmidt et al. |
| 4,038,622 | A | 7/1977 | Purcell |
| 4,047,068 | A | 9/1977 | Ress et al. |

(Continued)

FOREIGN PATENT DOCUMENTS

| | | |
|---|---|---|
| CA | 2629333 | 5/2007 |
| CN | 1537657 A | 10/2004 |

(Continued)

OTHER PUBLICATIONS

"Beam Delivery and Properties," *Journal of the ICRU*, 2007, 7(2):20 pages.

(Continued)

*Primary Examiner* — Douglas W Owens
*Assistant Examiner* — Srinivas Sathiraju
(74) *Attorney, Agent, or Firm* — Fish & Richardson P.C.

(57) ABSTRACT

An example particle accelerator includes a magnet to generate a magnetic field, where the magnet includes first superconducting coils to pass current in a first direction to thereby generate the first magnetic field, and where the first magnetic field is at least 4 Tesla (T). The example particle accelerator also includes an active return system including second superconducting coils. Each of the second superconducting coils surrounds, and is concentric with, a corresponding first superconducting coil. The second superconducting coils are for passing current in a second direction that is opposite to the first direction to thereby generate a second magnetic field having a magnetic field of at least 2.5 T. The second magnetic field has a polarity that is opposite to a polarity of the first magnetic field.

27 Claims, 8 Drawing Sheets

(56) References Cited

U.S. PATENT DOCUMENTS 4,112,306 A 9/1978 Nunan
4,129,784 A 12/1978 Tschunt et al.
4,139,777 A 2/1979 Rautenbach
4,197,510 A 4/1980 Szu
4,220,866 A 9/1980 Symmons et al.
4,230,129 A 10/1980 LeVeen
4,256,966 A 3/1981 Heinz
4,293,772 A 10/1981 Stieber
4,336,505 A 6/1982 Meyer
4,342,060 A 7/1982 Gibson
4,345,210 A 8/1982 Tran
4,353,033 A 10/1982 Karasawa
4,425,506 A 1/1984 Brown et al.
4,490,616 A 12/1984 Cipollina et al.
4,507,614 A 3/1985 Prono et al.
4,507,616 A 3/1985 Blosser et al.
4,589,126 A 5/1986 Augustsson et al.
4,598,208 A 7/1986 Brunelli et al.
4,628,523 A 12/1986 Heflin
4,633,125 A 12/1986 Blosser et al.
4,641,057 A 2/1987 Blosser et al.
4,641,104 A 2/1987 Blosser et al.
4,651,007 A 3/1987 Perusek et al.
4,680,565 A 7/1987 Jahnke
4,705,955 A 11/1987 Mileikowsky
4,710,722 A 12/1987 Jahnke
4,726,046 A 2/1988 Nunan
4,734,653 A 3/1988 Jahnke
4,736,173 A 4/1988 Blosser et al.
4,737,727 A 4/1988 Yamada et al.
4,739,173 A 4/1988 Blosser et al.
4,745,367 A 5/1988 Dustmann et al.
4,754,147 A 6/1988 Maughan et al.
4,763,483 A 8/1988 Olsen
4,767,930 A 8/1988 Stieber et al.
4,769,623 A 9/1988 Marsing et al.
4,771,208 A 9/1988 Jongen et al.
4,783,634 A 11/1988 Yamamoto et al.
4,808,941 A 2/1989 Marsing
4,812,658 A 3/1989 Koehler
4,843,333 A 6/1989 Marsing et al.
4,845,371 A 7/1989 Stieber
4,865,284 A 9/1989 Gosis et al.
4,868,843 A 9/1989 Nunan
4,868,844 A 9/1989 Nunan
4,870,287 A 9/1989 Cole et al.
4,880,985 A 11/1989 Jones
4,894,541 A 1/1990 Ono
4,896,206 A 1/1990 Denham
4,902,993 A 2/1990 Krevent
4,904,949 A 2/1990 Wilson
4,905,267 A 2/1990 Miller et al.
4,917,344 A 4/1990 Prechter et al.
4,943,781 A 7/1990 Wilson et al.
4,945,478 A 7/1990 Merickel et al.
4,968,915 A 11/1990 Wilson et al.
4,987,309 A 1/1991 Klasen et al.
4,992,744 A 2/1991 Fujita et al.
4,996,496 A 2/1991 Kitamura et al.
5,006,759 A 4/1991 Krispel
5,010,562 A 4/1991 Hernandez et al.
5,012,111 A 4/1991 Ueda
5,017,789 A 5/1991 Young et al.
5,017,882 A 5/1991 Finlan
5,036,290 A 7/1991 Sonobe et al.
5,039,057 A 8/1991 Prechter et al.
5,039,867 A 8/1991 Nishihara et al.
5,046,078 A 9/1991 Hernandez et al.
5,072,123 A 12/1991 Johnsen
5,111,042 A 5/1992 Sullivan et al.
5,111,173 A 5/1992 Matsuda et al.
5,117,194 A 5/1992 Nakanishi et al.
5,117,212 A 5/1992 Yamamoto et al.
5,117,829 A 6/1992 Miller et al.
5,148,032 A 9/1992 Hernandez
5,166,531 A 11/1992 Huntzinger
5,189,687 A 2/1993 Bova et al.
5,191,706 A 3/1993 Cosden
5,240,218 A 8/1993 Dye
5,260,579 A 11/1993 Yasuda et al.
5,260,581 A 11/1993 Lesyna et al.
5,278,533 A 1/1994 Kawaguchi
5,285,166 A 2/1994 Hiramoto et al.
5,317,164 A 5/1994 Kurokawa
5,336,891 A 8/1994 Crewe
5,341,104 A 8/1994 Anton et al.
5,349,198 A 9/1994 Takanaka
5,365,742 A 11/1994 Boffito et al.
5,374,913 A 12/1994 Pissantezky et al.
5,382,914 A 1/1995 Hamm et al.
5,401,973 A 3/1995 McKeown et al.
5,405,235 A 4/1995 Lebre et al.
5,434,420 A 7/1995 McKeown et al.
5,440,133 A 8/1995 Moyers et al.
5,451,794 A 9/1995 McKeown et al.
5,461,773 A 10/1995 Kawaguchi
5,463,291 A 10/1995 Carroll et al.
5,464,411 A 11/1995 Schulte et al.
5,492,922 A 2/1996 Palkowitz
5,511,549 A 4/1996 Legg et al.
5,521,469 A 5/1996 Laisne
5,538,942 A 7/1996 Koyama et al.
5,549,616 A 8/1996 Schulte et al.
5,561,697 A 10/1996 Takafuji et al.
5,585,642 A 12/1996 Britton et al.
5,633,747 A 5/1997 Nikoonahad
5,635,721 A 6/1997 Bardi et al.
5,668,371 A 9/1997 Deasy et al.
5,672,878 A 9/1997 Yao
5,691,679 A 11/1997 Ackermann et al.
5,726,448 A 3/1998 Smith et al.
5,727,554 A 3/1998 Kalend et al.
5,730,745 A 3/1998 Schulte et al.
5,751,781 A 5/1998 Brown et al.
5,778,047 A 7/1998 Mansfield et al.
5,783,914 A 7/1998 Hiramoto et al.
5,784,431 A 7/1998 Kalend et al.
5,797,924 A 8/1998 Schulte et al.
5,811,944 A 9/1998 Sampayan et al.
5,818,058 A 10/1998 Nakanishi et al.
5,821,705 A 10/1998 Caporasco et al.
5,825,845 A 10/1998 Blair et al.
5,841,237 A 11/1998 Alton
5,846,043 A 12/1998 Spath
5,851,182 A 12/1998 Sahadevan
5,866,912 A 2/1999 Slater et al.
5,874,811 A 2/1999 Finlan et al.
5,895,926 A 4/1999 Britton et al.
5,920,601 A 7/1999 Nigg et al.
5,929,458 A 7/1999 Nemezawa et al.
5,963,615 A 10/1999 Egley et al.
5,993,373 A 11/1999 Nonaka et al.
6,008,499 A 12/1999 Hiramoto et al.
6,034,377 A 3/2000 Pu
6,057,655 A 5/2000 Jongen
6,061,426 A 5/2000 Linders et al.
6,064,807 A 5/2000 Arai et al.
6,066,851 A 5/2000 Madono et al.
6,080,992 A 6/2000 Nonaka et al.
6,087,670 A 7/2000 Hiramoto et al.
6,094,760 A 8/2000 Nonaka et al.
6,118,848 A 9/2000 Reiffel
6,140,021 A 10/2000 Nakasuji et al.
6,144,875 A 11/2000 Sachweikard et al.
6,158,708 A 12/2000 Egley et al.
6,207,952 B1 3/2001 Kan et al.
6,219,403 B1 4/2001 Nishihara
6,222,905 B1 4/2001 Yoda et al.
6,241,671 B1 6/2001 Ritter et al.
6,246,066 B1 6/2001 Yuehu
6,256,591 B1 7/2001 Yoda et al.
6,265,837 B1 7/2001 Akiyama et al.
6,268,610 B1 7/2001 Pu
6,278,239 B1 8/2001 Caporasco et al.

(56) References Cited

U.S. PATENT DOCUMENTS 6,279,579 B1 8/2001 Riaziat et al.
6,307,914 B1 10/2001 Kunieda et al.
6,316,776 B1 11/2001 Hiramoto et al.
6,366,021 B1 4/2002 Meddaugh et al.
6,369,585 B2 4/2002 Yao
6,380,545 B1 4/2002 Yan
6,407,505 B1 6/2002 Bertsche
6,417,634 B1 7/2002 Bergstrom
6,433,336 B1 8/2002 Jongen et al.
6,433,349 B2 8/2002 Akiyama et al.
6,433,494 B1 8/2002 Kulish et al.
6,441,569 B1 8/2002 Janzow
6,443,349 B1 9/2002 Van Der Burg
6,465,957 B1 10/2002 Whitham et al.
6,472,834 B2 10/2002 Hiramoto et al.
6,476,403 B1 11/2002 Dolinskii et al.
6,492,922 B1 12/2002 New
6,493,424 B2 12/2002 Whitham
6,498,444 B1 12/2002 Hanna et al.
6,501,961 B1 12/2002 Kirkpatrick
6,501,981 B1 12/2002 Schweikard et al.
6,519,316 B1 2/2003 Collins
6,593,696 B2 7/2003 Ding et al.
6,594,336 B2 7/2003 Nishizawa et al.
6,600,164 B1 7/2003 Badura et al.
6,617,598 B1 9/2003 Matsuda
6,621,889 B1 9/2003 Mostafavi
6,639,234 B1 10/2003 Badura et al.
6,646,383 B2 11/2003 Bertsche et al.
6,670,618 B1 12/2003 Hartmann et al.
6,683,318 B1 1/2004 Haberer et al.
6,683,426 B1 1/2004 Kleeven
6,693,283 B2 2/2004 Eickhoff et al.
6,710,362 B2 3/2004 Kraft et al.
6,713,773 B1 3/2004 Lyons et al.
6,713,976 B1 3/2004 Zumoto et al.
6,717,162 B1 4/2004 Jongen
6,736,831 B1 5/2004 Hartmann et al.
6,745,072 B1 6/2004 Badura et al.
6,769,806 B2 8/2004 Moyers
6,774,383 B2 8/2004 Norimine et al.
6,777,689 B2 8/2004 Nelson
6,777,700 B2 8/2004 Yanagisawa et al.
6,780,149 B1 8/2004 Schulte
6,799,068 B1 9/2004 Hartmann et al.
6,800,866 B2 10/2004 Amemiya et al.
6,803,591 B2 10/2004 Muramatsu et al.
6,814,694 B1 11/2004 Pedroni
6,822,244 B2 11/2004 Beloussov et al.
6,853,703 B2 2/2005 Svatos et al.
6,864,770 B2 3/2005 Nemoto et al.
6,865,254 B2 3/2005 Nafstadius
6,873,123 B2 3/2005 Marchand et al.
6,891,177 B1 5/2005 Kraft et al.
6,891,924 B1 5/2005 Yoda et al.
6,894,300 B2 5/2005 Reimoser et al.
6,897,451 B2 5/2005 Kaercher et al.
6,914,396 B1 7/2005 Symons et al.
6,936,832 B2 8/2005 Norimine et al.
6,953,943 B2 10/2005 Yanagisawa et al.
6,965,116 B1 11/2005 Wagner et al.
6,969,194 B1 11/2005 Nafstadius
6,979,832 B2 12/2005 Yanagisawa et al.
6,984,835 B2 1/2006 Harada
6,992,312 B2 1/2006 Yanagisawa et al.
6,993,112 B2 1/2006 Hesse
7,008,105 B2 3/2006 Amann et al.
7,011,447 B2 3/2006 Moyers
7,012,267 B2 3/2006 Moriyama et al.
7,014,361 B1 3/2006 Ein-Gal
7,026,636 B2 4/2006 Yanagisawa et al.
7,038,403 B2 5/2006 Mastrangeli et al.
7,045,781 B2 5/2006 Adamec et al.
7,049,613 B2 5/2006 Yanagisawa et al.
7,053,389 B2 5/2006 Yanagisawa et al.
7,054,801 B2 5/2006 Sakamoto et al.
7,060,997 B2 6/2006 Norimine et al.
7,071,479 B2 7/2006 Yanagisawa et al.
7,073,508 B2 7/2006 Moyers
7,081,619 B2 7/2006 Bashkirov et al.
7,084,410 B2 8/2006 Beloussov et al.
7,091,478 B2 8/2006 Haberer
7,102,144 B2 9/2006 Matsuda et al.
7,122,811 B2 10/2006 Matsuda et al.
7,122,966 B2 10/2006 Norling et al.
7,122,978 B2 10/2006 Nakanishi et al.
7,135,678 B2 11/2006 Wang et al.
7,138,771 B2 11/2006 Bechthold et al.
7,154,107 B2 12/2006 Yanagisawa et al.
7,154,108 B2 12/2006 Tadokoro et al.
7,154,991 B2 12/2006 Earnst et al.
7,162,005 B2 1/2007 Bjorkholm
7,173,264 B2 2/2007 Moriyama et al.
7,173,265 B2 2/2007 Miller et al.
7,173,385 B2 2/2007 Caporasco et al.
7,186,991 B2 3/2007 Kato et al.
7,193,227 B2 3/2007 Hiramoto et al.
7,199,382 B2 4/2007 Rigney et al.
7,208,748 B2 4/2007 Sliski et al.
7,212,608 B2 5/2007 Nagamine et al.
7,212,609 B2 5/2007 Nagamine et al.
7,221,733 B1 5/2007 Takai et al.
7,227,161 B2 6/2007 Matsuda et al.
7,247,869 B2 7/2007 Tadokoro et al.
7,257,191 B2 8/2007 Sommer
7,259,529 B2 8/2007 Tanaka
7,262,424 B2 8/2007 Moriyama et al.
7,262,565 B2 8/2007 Fujisawa
7,274,018 B2 9/2007 Adamec et al.
7,280,633 B2 10/2007 Cheng et al.
7,295,649 B2 11/2007 Johnsen
7,297,967 B2 11/2007 Yanagisawa et al.
7,301,162 B2 11/2007 Matsuda et al.
7,307,264 B2 12/2007 Brusasco et al.
7,318,805 B2 1/2008 Schweikard et al.
7,319,231 B2 1/2008 Moriyama et al.
7,319,336 B2 1/2008 Baur et al.
7,331,713 B2 2/2008 Moyers
7,332,880 B2 2/2008 Ina et al.
7,345,291 B2 3/2008 Kats
7,345,292 B2 3/2008 Moriyama et al.
7,348,557 B2 3/2008 Armit
7,348,579 B2 3/2008 Pedroni
7,351,988 B2 4/2008 Naumann et al.
7,355,189 B2 4/2008 Yanagisawa et al.
7,368,740 B2 5/2008 Beloussov et al.
7,372,053 B2 5/2008 Yamashita et al.
7,378,672 B2 5/2008 Harada
7,381,979 B2 6/2008 Yamashita et al.
7,397,054 B2 7/2008 Natori et al.
7,397,901 B1 7/2008 Johnsen
7,398,309 B2 7/2008 Baumann et al.
7,402,822 B2 7/2008 Guertin et al.
7,402,823 B2 7/2008 Guertin et al.
7,402,824 B2 7/2008 Guertin et al.
7,402,963 B2 7/2008 Sliski
7,405,407 B2 7/2008 Hiramoto et al.
7,425,717 B2 9/2008 Matsuda et al.
7,432,516 B2 10/2008 Peggs et al.
7,439,528 B2 10/2008 Nishiuchi et al.
7,446,328 B2 11/2008 Rigney et al.
7,446,490 B2 11/2008 Jongen et al.
7,449,701 B2 11/2008 Fujimaki et al.
7,453,076 B2 11/2008 Welch et al.
7,465,944 B2 12/2008 Ueno et al.
7,466,085 B2 12/2008 Nutt
7,468,506 B2 12/2008 Rogers et al.
7,473,913 B2 1/2009 Hermann et al.
7,476,867 B2 1/2009 Fritsch et al.
7,476,883 B2 1/2009 Nutt
7,482,606 B2 1/2009 Groezinger et al.
7,492,556 B2 2/2009 Atkins et al.
7,507,975 B2 3/2009 Mohr
7,525,104 B2 4/2009 Harada

(56) References Cited

U.S. PATENT DOCUMENTS 7,541,905 B2 * 6/2009 Antaya ..... 335/216
7,547,901 B2 6/2009 Guertin et al.
7,554,096 B2 6/2009 Ward et al.
7,554,097 B2 6/2009 Ward et al.
7,555,103 B2 6/2009 Johnsen
7,557,358 B2 7/2009 Ward et al.
7,557,359 B2 7/2009 Ward et al.
7,557,360 B2 7/2009 Ward et al.
7,557,361 B2 7/2009 Ward et al.
7,560,715 B2 7/2009 Pedroni
7,560,717 B2 7/2009 Matsuda et al.
7,567,694 B2 7/2009 Lu et al.
7,574,251 B2 8/2009 Lu et al.
7,576,499 B2 8/2009 Caporaso et al.
7,579,603 B2 8/2009 Birgy et al.
7,579,610 B2 8/2009 Grozinger et al.
7,582,866 B2 9/2009 Furuhashi et al.
7,582,885 B2 9/2009 Katagiri et al.
7,582,886 B2 9/2009 Trbojevic
7,586,112 B2 9/2009 Chiba et al.
7,598,497 B2 10/2009 Yamamoto et al.
7,609,009 B2 10/2009 Tanaka et al.
7,609,809 B2 10/2009 Kapatoes et al.
7,609,811 B1 10/2009 Siljamaki et al.
7,615,942 B2 11/2009 Sanders et al.
7,629,598 B2 12/2009 Harada
7,639,853 B2 12/2009 Olivera et al.
7,639,854 B2 12/2009 Schnarr et al.
7,643,661 B2 1/2010 Ruchala et al.
7,656,258 B1 * 2/2010 Antaya et al. ..... 335/216
7,659,521 B2 2/2010 Pedroni
7,659,528 B2 2/2010 Uematsu
7,668,291 B2 2/2010 Nord et al.
7,672,429 B2 3/2010 Urano et al.
7,679,073 B2 3/2010 Urano et al.
7,682,078 B2 3/2010 Rietzel
7,692,166 B2 4/2010 Muraki et al.
7,692,168 B2 4/2010 Moriyama et al.
7,696,499 B2 4/2010 Miller et al.
7,696,847 B2 4/2010 Antaya
7,701,677 B2 4/2010 Schultz et al.
7,709,818 B2 5/2010 Matsuda et al.
7,710,051 B2 5/2010 Caporaso et al.
7,728,311 B2 * 6/2010 Gall ..... 250/492.21
7,746,978 B2 6/2010 Cheng et al.
7,755,305 B2 7/2010 Umezawa et al.
7,759,642 B2 7/2010 Nir
7,763,867 B2 7/2010 Birgy et al.
7,767,988 B2 8/2010 Kaiser et al.
7,770,231 B2 8/2010 Prater et al.
7,772,577 B2 8/2010 Saito et al.
7,773,723 B2 8/2010 Nord et al.
7,773,788 B2 8/2010 Lu et al.
7,778,488 B2 8/2010 Nord et al.
7,783,010 B2 8/2010 Clayton
7,784,127 B2 8/2010 Kuro et al.
7,786,451 B2 8/2010 Ward et al.
7,786,452 B2 8/2010 Ward et al.
7,789,560 B2 9/2010 Moyers
7,791,051 B2 9/2010 Beloussov et al.
7,796,731 B2 9/2010 Nord et al.
7,801,269 B2 9/2010 Cravens et al.
7,801,270 B2 9/2010 Nord et al.
7,801,988 B2 9/2010 Baumann et al.
7,807,982 B2 10/2010 Nishiuchi et al.
7,809,107 B2 10/2010 Nord et al.
7,812,319 B2 10/2010 Diehl et al.
7,812,326 B2 10/2010 Grozinger et al.
7,816,657 B2 10/2010 Hansmann et al.
7,817,778 B2 10/2010 Nord et al.
7,817,836 B2 10/2010 Chao et al.
7,834,334 B2 11/2010 Grozinger et al.
7,834,336 B2 11/2010 Boeh et al.
7,835,494 B2 11/2010 Nord et al.
7,835,502 B2 11/2010 Spence et al.
7,839,972 B2 11/2010 Ruchala et al.
7,839,973 B2 11/2010 Nord et al.
7,848,488 B2 12/2010 Mansfield
7,857,756 B2 12/2010 Warren et al.
7,860,216 B2 12/2010 Jongen et al.
7,860,550 B2 12/2010 Saracen et al.
7,868,301 B2 1/2011 Diehl
7,875,801 B2 1/2011 Tsotsis
7,875,861 B2 1/2011 Huttenberger et al.
7,875,868 B2 1/2011 Moriyama et al.
7,881,431 B2 2/2011 Aoi et al.
7,894,574 B1 2/2011 Nord et al.
7,906,769 B2 3/2011 Blasche et al.
7,914,734 B2 3/2011 Livingston
7,919,765 B2 4/2011 Timmer
7,920,040 B2 4/2011 Antaya et al.
7,920,675 B2 4/2011 Lomax et al.
7,928,415 B2 4/2011 Bert et al.
7,934,869 B2 5/2011 Ivanov et al.
7,940,881 B2 5/2011 Jongen et al.
7,943,913 B2 5/2011 Balakin
7,947,969 B2 5/2011 Pu
7,949,096 B2 5/2011 Cheng et al.
7,950,587 B2 5/2011 Henson et al.
7,960,710 B2 6/2011 Kruip et al.
7,961,844 B2 6/2011 Takeda et al.
7,977,648 B2 7/2011 Westerly et al.
7,977,656 B2 7/2011 Fujimaki et al.
7,982,198 B2 7/2011 Nishiuchi et al.
7,982,416 B2 7/2011 Tanaka et al.
7,984,715 B2 7/2011 Moyers
7,986,768 B2 7/2011 Nord et al.
7,987,053 B2 7/2011 Schaffner
7,989,785 B2 8/2011 Emhofer et al.
7,990,524 B2 8/2011 Jureller et al.
7,997,553 B2 8/2011 Sloan et al.
8,002,466 B2 8/2011 Von Neubeck et al.
8,003,964 B2 8/2011 Stark et al.
8,009,803 B2 8/2011 Nord et al.
8,009,804 B2 8/2011 Siljamaki et al.
8,039,822 B2 10/2011 Rietzel
8,041,006 B2 10/2011 Boyden et al.
8,044,364 B2 10/2011 Yamamoto
8,049,187 B2 11/2011 Tachikawa
8,053,508 B2 11/2011 Korkut et al.
8,053,739 B2 11/2011 Rietzel
8,053,745 B2 11/2011 Moore
8,053,746 B2 11/2011 Timmer et al.
8,067,748 B2 11/2011 Balakin
8,069,675 B2 12/2011 Radovinsky et al.
8,071,966 B2 12/2011 Kaiser et al.
8,080,801 B2 12/2011 Safai
8,085,899 B2 12/2011 Nord et al.
8,089,054 B2 1/2012 Balakin
8,093,564 B2 1/2012 Balakin
8,093,568 B2 * 1/2012 Mackie et al. ..... 250/492.3
8,111,125 B2 * 2/2012 Antaya et al. ..... 336/185
8,129,699 B2 3/2012 Balakin
8,144,832 B2 3/2012 Balakin
8,173,981 B2 5/2012 Trbojevic
8,188,688 B2 5/2012 Balakin
8,198,607 B2 6/2012 Balakin
8,222,613 B2 7/2012 Tajiri et al.
8,227,768 B2 7/2012 Smick et al.
8,232,536 B2 7/2012 Harada
8,288,742 B2 10/2012 Balakin
8,291,717 B2 10/2012 Radovinsky et al.
8,294,127 B2 10/2012 Tachibana
8,304,725 B2 11/2012 Komuro et al.
8,304,750 B2 11/2012 Preikszas et al.
8,309,941 B2 11/2012 Balakin
8,330,132 B2 12/2012 Guertin et al.
8,334,520 B2 12/2012 Otaka et al.
8,335,397 B2 12/2012 Takane et al.
8,344,340 B2 * 1/2013 Gall et al. ..... 250/505.1
8,350,214 B2 1/2013 Otaki et al.
8,368,038 B2 2/2013 Balakin
8,368,043 B2 2/2013 Havelange et al.
8,373,143 B2 2/2013 Balakin

(56) References Cited

U.S. PATENT DOCUMENTS

| | | | |
|---|---|---|---|
| 8,373,145 | B2 | 2/2013 | Balakin |
| 8,378,299 | B2 | 2/2013 | Frosien |
| 8,378,321 | B2 | 2/2013 | Balakin |
| 8,382,943 | B2 | 2/2013 | Clark |
| 8,389,949 | B2 | 3/2013 | Harada et al. |
| 8,399,866 | B2 | 3/2013 | Balakin |
| 8,405,042 | B2 | 3/2013 | Honda et al. |
| 8,405,056 | B2 | 3/2013 | Amaldi et al. |
| 8,415,643 | B2 | 4/2013 | Balakin |
| 8,416,918 | B2 | 4/2013 | Nord et al. |
| 8,421,041 | B2 | 4/2013 | Balakin |
| 8,426,833 | B2 | 4/2013 | Trbojevic |
| 8,436,323 | B2 | 5/2013 | Iseki et al. |
| 8,440,987 | B2 | 5/2013 | Stephani et al. |
| 8,445,872 | B2 | 5/2013 | Behrens et al. |
| 8,466,441 | B2 | 6/2013 | Iwata et al. |
| 8,472,583 | B2 | 6/2013 | Star-Lack et al. |
| 8,483,357 | B2 | 7/2013 | Siljamaki et al. |
| 8,487,278 | B2 | 7/2013 | Balakin |
| 8,552,406 | B2 | 10/2013 | Phaneuf et al. |
| 8,552,408 | B2 | 10/2013 | Hanawa et al. |
| 8,569,717 | B2 | 10/2013 | Balakin |
| 8,581,215 | B2 | 11/2013 | Balakin |
| 8,581,523 | B2 | 11/2013 | Gall et al. |
| 8,581,525 | B2 | 11/2013 | Antaya et al. |
| 2002/0172317 | A1 | 11/2002 | Maksimchuk et al. |
| 2003/0048080 | A1 | 3/2003 | Amemiya et al. |
| 2003/0125622 | A1 | 7/2003 | Schweikard et al. |
| 2003/0136924 | A1 | 7/2003 | Kraft et al. |
| 2003/0152197 | A1 | 8/2003 | Moyers |
| 2003/0163015 | A1 | 8/2003 | Yanagisawa et al. |
| 2003/0183779 | A1 | 10/2003 | Norimine et al. |
| 2003/0234369 | A1 | 12/2003 | Glukhoy |
| 2004/0000650 | A1 | 1/2004 | Yanagisawa et al. |
| 2004/0017888 | A1 | 1/2004 | Seppi et al. |
| 2004/0056212 | A1 | 3/2004 | Yanagisawa et al. |
| 2004/0061077 | A1 | 4/2004 | Muramatsu et al. |
| 2004/0061078 | A1 | 4/2004 | Muramatsu et al. |
| 2004/0085023 | A1 | 5/2004 | Chistyakov |
| 2004/0098445 | A1 | 5/2004 | Baumann et al. |
| 2004/0111134 | A1 | 6/2004 | Muramatsu et al. |
| 2004/0118081 | A1 | 6/2004 | Reimoser et al. |
| 2004/0149934 | A1 | 8/2004 | Yanagisawa et al. |
| 2004/0159795 | A1 | 8/2004 | Kaercher et al. |
| 2004/0173763 | A1 | 9/2004 | Moriyama et al. |
| 2004/0174958 | A1 | 9/2004 | Moriyama et al. |
| 2004/0183033 | A1 | 9/2004 | Moriyama et al. |
| 2004/0183035 | A1 | 9/2004 | Yanagisawa et al. |
| 2004/0200982 | A1 | 10/2004 | Moriyama et al. |
| 2004/0200983 | A1 | 10/2004 | Fujimaki et al. |
| 2004/0213381 | A1 | 10/2004 | Harada |
| 2004/0227104 | A1 | 11/2004 | Matsuda et al. |
| 2004/0232356 | A1 | 11/2004 | Norimine et al. |
| 2004/0240626 | A1 | 12/2004 | Moyers |
| 2005/0058245 | A1 | 3/2005 | Ein-Gal |
| 2005/0089141 | A1 | 4/2005 | Brown |
| 2005/0161618 | A1 | 7/2005 | Eros |
| 2005/0184686 | A1 | 8/2005 | Caporaso et al. |
| 2005/0228255 | A1 | 10/2005 | Saracen et al. |
| 2005/0234327 | A1 | 10/2005 | Saracen et al. |
| 2005/0247890 | A1 | 11/2005 | Norimine et al. |
| 2006/0017015 | A1 | 1/2006 | Sliski et al. |
| 2006/0067468 | A1 | 3/2006 | Rietzel |
| 2006/0126792 | A1 | 6/2006 | Li |
| 2006/0145088 | A1 | 7/2006 | Ma |
| 2006/0284562 | A1 | 12/2006 | Hruby et al. |
| 2007/0001128 | A1 | 1/2007 | Sliski et al. |
| 2007/0013273 | A1 | 1/2007 | Albert et al. |
| 2007/0014654 | A1 | 1/2007 | Haverfield et al. |
| 2007/0023699 | A1 | 2/2007 | Yamashita et al. |
| 2007/0029510 | A1 | 2/2007 | Hermann et al. |
| 2007/0051904 | A1 | 3/2007 | Kaiser et al. |
| 2007/0092812 | A1 | 4/2007 | Caporaso et al. |
| 2007/0114945 | A1 | 5/2007 | Mattaboni et al. |
| 2007/0121926 | A1 | 5/2007 | Le Gall et al. |
| 2007/0145916 | A1 | 6/2007 | Caporaso et al. |
| 2007/0171015 | A1 | 7/2007 | Antaya |
| 2007/0181519 | A1 | 8/2007 | Khoshnevis |
| 2007/0284548 | A1 | 12/2007 | Kaiser et al. |
| 2008/0093567 | A1 | 4/2008 | Gall |
| 2008/0218102 | A1 | 9/2008 | Sliski |
| 2009/0096179 | A1 | 4/2009 | Stark et al. |
| 2009/0140671 | A1 | 6/2009 | O'Neal et al. |
| 2009/0140672 | A1 | 6/2009 | Gall et al. |
| 2009/0200483 | A1 | 8/2009 | Gall et al. |
| 2010/0045213 | A1 | 2/2010 | Sliski et al. |
| 2010/0230617 | A1 | 9/2010 | Gall |
| 2012/0142538 | A1* | 6/2012 | Antaya et al. ..... 505/211 |
| 2013/0009571 | A1* | 1/2013 | Antaya ..... 315/502 |
| 2013/0053616 | A1* | 2/2013 | Gall et al. ..... 600/1 |
| 2014/0028220 | A1 | 1/2014 | Bromberg et al. |
| 2014/0042934 | A1 | 2/2014 | Tsutsui |

FOREIGN PATENT DOCUMENTS

| | | | |
|---|---|---|---|
| CN | 101932361 | | 12/2010 |
| CN | 101933405 | | 12/2010 |
| CN | 101933406 | | 12/2010 |
| CN | 101061759 | | 5/2011 |
| DE | 2753397 | | 6/1978 |
| DE | 31 48 100 | | 6/1983 |
| DE | 35 30 446 | | 8/1984 |
| DE | 41 01 094 | C1 | 5/1992 |
| DE | 4411171 | | 10/1995 |
| EP | 0 194 728 | | 9/1986 |
| EP | 0 277 521 | | 8/1988 |
| EP | 0 208 163 | | 1/1989 |
| EP | 0 222 786 | | 7/1990 |
| EP | 0 221 987 | | 1/1991 |
| EP | 0 499 253 | | 8/1992 |
| EP | 0 306 966 | | 4/1995 |
| EP | 0 388 123 | | 5/1995 |
| EP | 0 465 597 | | 5/1997 |
| EP | 0 911 064 | | 6/1998 |
| EP | 0 864 337 | | 9/1998 |
| EP | 0 776 595 | | 12/1998 |
| EP | 1 069 809 | | 1/2001 |
| EP | 1 153 398 | | 4/2001 |
| EP | 1 294 445 | | 3/2003 |
| EP | 1 348 465 | | 10/2003 |
| EP | 1 358 908 | | 11/2003 |
| EP | 1 371 390 | | 12/2003 |
| EP | 1 402 923 | | 3/2004 |
| EP | 1 430 932 | | 6/2004 |
| EP | 1 454 653 | | 9/2004 |
| EP | 1 454 654 | | 9/2004 |
| EP | 1 454 655 | | 9/2004 |
| EP | 1 454 656 | | 9/2004 |
| EP | 1 454 657 | | 9/2004 |
| EP | 1 477 206 | | 11/2004 |
| EP | 1 738 798 | | 1/2007 |
| EP | 1 826 778 | | 8/2007 |
| EP | 1 949 404 | | 7/2008 |
| EP | 2227295 | | 9/2010 |
| EP | 2232961 | | 9/2010 |
| EP | 2232962 | | 9/2010 |
| EP | 2227295 | | 5/2011 |
| EP | 1 605 742 | | 6/2011 |
| EP | 2363170 | | 9/2011 |
| EP | 2363171 | | 9/2011 |
| FR | 2 560 421 | | 8/1985 |
| FR | 2911843 | | 8/2008 |
| GB | 0 957 342 | | 5/1964 |
| GB | 2 015 821 | | 9/1979 |
| GB | 2 361 523 | | 10/2001 |
| JP | 43-23267 | | 10/1968 |
| JP | 57-162527 | | 10/1982 |
| JP | 58-141000 | | 8/1983 |
| JP | 61-80800 | | 4/1986 |
| JP | 62-150804 | | 7/1987 |
| JP | 62-186500 | | 8/1987 |
| JP | 10-071213 | | 3/1988 |
| JP | 63-149344 | | 6/1988 |
| JP | 63-218200 | | 9/1988 |

(56) References Cited

FOREIGN PATENT DOCUMENTS

| | | |
|---|---|---|
| JP | 63-226899 | 9/1988 |
| JP | 64-89621 | 4/1989 |
| JP | 01-276797 | 11/1989 |
| JP | 01-302700 | 12/1989 |
| JP | 4-94198 | 3/1992 |
| JP | 04-128717 | 4/1992 |
| JP | 04-129768 | 4/1992 |
| JP | 04-273409 | 9/1992 |
| JP | 04-337300 | 11/1992 |
| JP | 05-341352 | 12/1993 |
| JP | 06-233831 | 8/1994 |
| JP | 06-036893 | 10/1994 |
| JP | 07-260939 | 10/1995 |
| JP | 07-263196 | 10/1995 |
| JP | 08-173890 | 7/1996 |
| JP | 08-264298 | 10/1996 |
| JP | 09-162585 | 6/1997 |
| JP | 11-47287 | 2/1999 |
| JP | 11-102800 | 4/1999 |
| JP | 11-243295 | 9/1999 |
| JP | 2000-294399 | 10/2000 |
| JP | 2001-6900 | 1/2001 |
| JP | 2001-129103 | 5/2001 |
| JP | 2002-164686 | 6/2002 |
| JP | 2003-517755 | 5/2003 |
| JP | 05-046928 | 3/2008 |
| JP | 2008-507826 | 3/2008 |
| JP | 2009-515671 | 4/2009 |
| JP | 2009-516905 | 4/2009 |
| JP | 2011-505191 | 2/2011 |
| JP | 2011-505670 | 2/2011 |
| JP | 2011-507151 | 3/2011 |
| SU | 300137 | 11/1969 |
| SU | 569 635 | 8/1977 |
| TW | 200930160 | 7/2009 |
| TW | 200934682 | 8/2009 |
| TW | 200939908 | 9/2009 |
| TW | 200940120 | 10/2009 |
| WO | WO 86/07229 | 12/1986 |
| WO | WO 90/012413 | 10/1990 |
| WO | WO 92/03028 | 2/1992 |
| WO | WO 93/02536 | 2/1993 |
| WO | WO 98/17342 | 4/1998 |
| WO | WO 99/39385 | 8/1999 |
| WO | WO 00/40064 | 7/2000 |
| WO | WO 00/49624 | 8/2000 |
| WO | WO 01/26230 | 4/2001 |
| WO | WO 01/26569 | 4/2001 |
| WO | WO 02/07817 | 1/2002 |
| WO | WO 03/039212 | 5/2003 |
| WO | WO 03/092812 | 11/2003 |
| WO | WO 2004/026401 | 4/2004 |
| WO | WO 2004/101070 | 11/2004 |
| WO | WO 2006-012467 | 2/2006 |
| WO | WO 2007/061937 | 5/2007 |
| WO | WO 2007/084701 | 7/2007 |
| WO | WO 2007/130164 | 11/2007 |
| WO | WO 2007/145906 | 12/2007 |
| WO | WO 2008/030911 | 3/2008 |
| WO | WO 2008/081480 | 10/2008 |
| WO | WO 2009/048745 | 4/2009 |
| WO | WO 2009/070173 | 6/2009 |
| WO | WO 2009/070588 | 6/2009 |
| WO | WO 2009/073480 | 6/2009 |
| WO | WO2014/018706 | 1/2014 |
| WO | WO2014/018876 | 1/2014 |

OTHER PUBLICATIONS

"510(k) Summary: Ion Beam Applications S.A.", FDA, Jul. 12, 2001, 5 pages.

"510(k) Summary: Optivus Proton Beam Therapy System", Jul. 21, 2000, 5 pages.

"An Accelerated Collaboration Meets with Beaming Success," Lawrence Livermore National Laboratory, Apr. 12, 2006, S&TR, Livermore, California, pp. 1-3, http://www.llnl.gov/str/April06/Caporaso.html.

"CPAC Highlights Its Proton Therapy Program at ESTRO Annual Meeting", TomoTherapy Incorporated, Sep. 18, 2008, Madison, Wisconsin, pp. 1-2.

"Indiana's mega-million proton therapy cancer center welcomes its first patients" [online] Press release, Health & Medicine Week, 2004, retrieved from NewsRx.com, Mar. 1, 2004, pp. 119-120.

"LLNL, UC Davis Team Up to Fight Cancer,"Lawrence Livermore National Laboratory, Apr. 28, 2006, SF-06-04-02, Livermore, California, pp. 1-4.

"Patent Assignee Search Paul Scherrer Institute," Library Services at Fish & Richardson P.C., Mar. 20, 2007, 40 pages.

"Patent Prior Art Search for 'Proton Therapy System'," Library Services at Fish & Richardson P.C., Mar. 20, 2007, 46 pages.

"Superconducting Cyclotron Contract" awarded by Paul Scherrer Institute (PSI), Villigen, Switzerland, http://www.accel.de/News/superconducting_cyclotron_contract.htm, Jan. 2009, 1 page.

"The Davis 76-Inch Isochronous Cyclotron", Beam On: Crocker Nuclear Laboratory, University of California, 2009, 1 page.

"The K100 Neutron-therapy Cyclotron," National Superconducting Cyclotron Laboratory at Michigan State University (NSCL), retrieved from: http://www.nscl.msu.edu/tech/accelerators/k100, Feb. 2005, 1 page.

"The K250 Proton therapy Cyclotron," National Superconducting Cyclotron Laboratory at Michigan State University (NSCL), retrieved from: http://www.nscl.msu.edu/tech/accelerators/k250.html, Feb. 2005, 2 pages.

"The K250 Proton-therapy Cyclotron Photo Illustration," National Superconducting Cyclotron Laboratory at Michigan State University (NSCL), retrieved from: http://www.nscl.msu.edu/media/image/experimental-equipment-technology/250.html, Feb. 2005, 2 pages.

18$^{th}$ Japan Conference on Radiation and Radioisotopes [Japanese], Nov. 25-27, 1987, 9 pages.

Abrosimov et al., "1000MeV Proton Beam Therapy facility at Petersburg Nuclear Physics Institute Synchrocyclotron," Medical Radiology (Moscow) 32, 10 (1987) revised in Journal of Physics, Conference Series 41, 2006, pp. 424-432, Institute of Physics Publishing Limited.

Abrosimov et al., *Proc. Academy Science*, 1985, USSR 5, p. 84.

Adachi et al., "A 150MeV FFAG Synchrotron with "Return-Yoke Free" Magent," *Proceedings of the 2001 Particle Accelerator Conference*, Chicago, 2001, 3 pages.

Ageyev et al., "The IHEP Accelerating and Storage Complex (UNK) Status Report," *11th International Conference on High-Energy Accelerators*, 1980, pp. 60-70.

Agosteo et al., "Maze Design of a gantry room for proton therapy," *Nuclear Instruments & Methods In Physics Research*, 1996, Section A, 382, pp. 573-582.

Alexeev et al., "R4 Design of Superconducting Magents for Proton Synchrotrons," *Proceedings of the Fifth International Cryogenic Engineering Conference*, 1974, pp. 531-533.

Allardyce et al., "Performance and Prospects of the Reconstructed CERN 600 MeV Synchrocyclotron," *IEEE Transactions on Nuclear Science USA*, Jun. 1977, ns-24:(3)1631-1633.

Alonso, "Magnetically Scanned Ion Beams for Radiation Therapy," Accelerator & Fusion Research Division, Lawrence Berkeley Laboratory, Berkeley, CA, Oct. 1988, 13 pages.

Amaldi et al., "The Italian project for a hadrontherapy centre" *Nuclear Instruments and Methods in Physics Research A*, 1995, 360, pp. 297-301.

Amaldi, "Overview of the world landscape of Hadrontherapy and the projects of the TERA foundation," Physica Medica, An International journal Devoted to the Applications of Physics to Medicine and Biology, Jul. 1998, vol. XIV, Supplement 1, 6th Workshop on Heavy Charged Particles in Biology and Medicine, Instituto Scientific Europeo (ISE), Sep. 29-Oct. 1, 1977, Baveno, pp. 76-85.

Anferov et al., "Status of the Midwest Proton Radiotherapy Institute," Proceedings of the 2003 Particle Accelerator Conference, 2003, pp. 699-701.

(56) References Cited

OTHER PUBLICATIONS

Anferov et al., "The Indiana University Midwest Proton Radiation Institute," Proceedings of the 2001 Particle Accelerator Conference, 2001, Chicago, pp. 645-647.
Appun, "Various problems of magnet fabrication for high-energy accelerators," *Journal for All Engineers Interested in the Nuclear Field*, 1967, pp. 10-16 (1967) [Lang.: German], English bibliographic information (http://www.osti.gov/energycitations/product.biblio.jsp?osti_id=4442292).
Arduini et al. "Physical specifications of clinical proton beams from a synchrotron," *Med. Phys*, Jun. 1996, 23 (6): 939-951.
Badano et al., "Proton-Ion Medical Machine Study (PIMMS) Part I," PIMMS, Jan. 1999, 238 pages.
Beeckman et al., "Preliminary design of a reduced cost proton therapy facility using a compact, high field isochronous cyclotron," *Nuclear Instruments and Methods in Physics Reasearch B*56/57, 1991, pp. 1201-1204.
Bellomo et al., "The Superconducting Cyclotron Program at Michigan State University," *Bulletin of the American Physical Society*, Sep. 1980, 25(7):767.
Benedikt and Carli, "Matching to Gantries for Medical Synchrotrons" *IEEE Proceedings of the 1997 Particle Accelerator Conference*, 1997, pp. 1379-1381.
Bieth et al., "A Very Compact Protontherapy Facility Based on an Extensive Use of High Temperature Superconductors (HTS)" *Cyclotrons and their Applications* 1998, Proceedings of the Fifteenth International Conference on Cyclotrons and their Applications, Caen, Jun. 14-19, 1998, pp. 669-672.
Bigham, "Magnetic Trim Rods for Superconducting Cyclotrons," Nuclear Instruments and Methods (North-Holland Publishing Co.), 1975, 141:223-228.
Bimbot, "First Studies of the Extemal Beam from the Orsay S.C. 200 MeV," Institut de Physique Nucleaire, BP 1, Orsay, France, *IEEE*, 1979, pp. 1923-1926.
Blackmore et al., "Operation of the Triumf Proton Therapy Facility," *IEEE Proceedings of the 1997 Particle Accelerator Conferenc*, May 12-16, 1997 3:3831-3833.
Bloch, "The Midwest Proton Therapy Center," Application of Accelerators in Research and Industry, Proceedings of the Fourteenth Int'l Conf., Part Two, Nov. 1996, pp. 1253-1255.
Blosser et al., "Problems and Accomplishments of Superconducting Cyclotrons," Proceedings of the 14$^{th}$ International Conference, Cyclotrons and Their Applications, Oct. 1995, pp. 674-684.
Blosser et al., "Superconducting Cyclotrons", Seventh International Conference on Cyclotrons and their Applications, Aug. 19-22, 1975, pp. 584-594.
Blosser et al., "Progress toward an experiment to study the effect of RF grounding in an internal ion source on axial oscillations of the beam in a cyclotron," National Superconducting Cyclotron Laboratory, Michigan State University, Report MSUCL-760, CP600, Cyclotrons and their Applications 2011, Sixteenth International Conference, 2001, pp. 274-276.
Blosser et al., "A Compact Superconducting Cyclotron for the Production of High Intensity Protons," Proceedings of the 1997 Particle Accelerator Conference, May 12-16, 1997, 1:1054-1056.
Blosser et al., "Advances in Superconducting Cyclotrons at Michigan State University," Proceedings of the 11$^{th}$ International Conference on Cyclotrons and their Applications, Oct. 1986, pp. 157-167, Tokyo.
Blosser et al., "Characteristics of a 400 (Q2/A) MeV Super-Conducting Heavy-Ion Cyclotron," Bulletin of the American Physical Society, Oct. 1974, p. 1026.
Blosser et al., "Medical Accelerator Projects at Michigan State Univ." IEEE Proceedings of the 1989 Particle Accelerator Conference, Mar. 20-23, 1989, 2:742-746.
Blosser et al., "Superconducting Cyclotron for Medical Application", *IEEE Transactions on Magnetics*, Mar. 1989, 25(2): 1746-1754.
Blosser, "Application of Superconductivity in Cyclotron Construction," *Ninth International Conference on Cyclotrons and their Applications*, Sep. 1981, pp. 147-157.
Blosser, "Applications of Superconducting Cyclotrons," Twelfth International Conference on Cyclotrons and Their Applications, May 8-12, 1989, pp. 137-144.
Blosser, "Future Cyclotrons," AIP, *The Sixth International Cyclotron Conference*, 1972, pp. 16-32.
Blosser, "Medical Cyclotrons," *Physics Today*, Special Issue Physical Review Centenary, Oct. 1993, pp. 70-73.
Blosser, "Preliminary Design Study Exploring Building Features Required for a Proton Therapy Facility for the Ontario Cancer Institute", Mar. 1991, MSUCL-760a, 53 pages.
Blosser, "Program on the Coupled Superconducting Cyclotron Project," *Bulletin of the American Physical Society*, Apr. 1981, 26(4):558.
Blosser, "Synchrocyclotron Improvement Programs," *IEEE Transactions on Nuclear Science USA*, Jun. 1969, 16(3):Part I, pp. 405-414.
Blosser, "The Michigan State University Superconducting Cyclotron Program," *Nuclear Science*, Apr. 1979, NS-26(2):2040-2047.
Blosser, National Superconducting Cyclotron Laboratory, Michigan State University, Report MSUCL-760, 2001, 3 pages.
Blosser, H., Present and Future Superconducting Cyclotrons, *Bulletin of the American Physical Society*, Feb. 1987, 32(2):171 Particle Accelerator Conference, Washington, D.C.
Blosser, H.G., "Superconducting Cyclotrons at Michigan State University", Nuclear Instruments & Methods in Physics Research, 1987, vol. B 24/25, part II, pp. 752-756.
Botha et al., "A New Multidisciplinary Separated-Sector Cyclotron Facility," *IEEE Transactions on Nuclear Science*, 1977, NS-24(3):1118-1120.
Canadian Office action issued in Canadian application No. 2,629,333 issued Aug. 30, 2010, 5 pages.
Chichili et al., "Fabrication of Nb3Sn Shell-Type Coils with Pre-Preg Ceramic Insulation," American Institute of Physics Conference Proceedings, AIP USA, No. 711, (XP-002436709, ISSN: 0094-243X), 2004, pp. 450-457.
Chinese Office action from corresponding Chinese application No. 200880125832.9, mailed Jun. 5, 2012, 6 pages.
Chinese Office Action issued in Chinese Application No. 200780102281.X, dated Dec. 7, 2011, 23 pages (with English translation).
Chinese Office action issued in Chinese application No. 200880125832.9, dated Sep. 22, 2011, 111 pages.
Chinese Office action issued in Chinese application No. 200880125918.1, dated Sep. 15, 2011, 111 pages.
Chong et al., Radiology Clinic North American 7, 3319, 1969, 27 pages.
Chu et al., "Performance Specifications for Proton Medical Facility," Lawrence Berkeley Laboratory, University of California, Mar. 1993, 128 pages.
Chu et al., "Instrumentation for Treatment of Cancer Using Proton and Light-ion Beams," Review of Scientific Instruments, Aug. 1993, 64 (8):2055-2122.
Chu, "Instrumentation in Medical Systems," Accelerator and Fusion Research Division, Lawrence Berkeley Laboratory, University of California, Berkeley, CA, May 1995, 9 pages.
Cole et al., "Design and Application of a Proton Therapy Accelerator," Fermi National Accelerator Laboratory, *IEEE*, 1985, 5 pages.
Collins, et al., "The Indiana University Proton Therapy System," Proceedings of EPAC 2006, Edinburgh, Scotland, 2006, 3 pages.
Conradi et al., "Proposed New Facilities for Proton Therapy at iThemba Labs," *Proceedings of EPAC*, 2002, pp. 560-562.
C/E Source of Ions for Use in Sychro-Cyclotrons Search, Jan. 31, 2005, 9 pages.
Source Search "Cites of U.S. and Foreign Patents/Published applications in the name of Mitsubishi Denki Kabushiki Kaisha and Containing the Keywords (Proton and Synchrocyclotron)," Jan. 2005, 8 pages.
Cosgrove et al., "Microdosimetric Studies on the Orsay Proton Synchrocyclotron at 73 and 200 MeV," *Radiation Protection Dosimetry*, 1997, 70(1-4):493-496.
Coupland, "High-field (5 T) pulsed superconducting dipole magnet," *Proceedings of the Institution of Electrical Engineers*, Jul. 1974, 121(7):771-778.

(56) References Cited

OTHER PUBLICATIONS

Coutrakon et al. "Proton Synchrotrons for Cancer Therapy," Application of Accelerators in Research and Industry—Sixteenth International Conf., American Institute of Physics, Nov. 1-5, 2000, vol. 576, pp. 861-864.
Coutrakon et al., "A prototype beam delivery system for the proton medical accelerator at Loma Linda," *Medical Physics*, Nov./Dec. 1991, 18(6):1093-1099.
Cuttone, "Applications of a Particle Accelerators in Medical Physics," Istituto Nazionale di Fisica Nucleare-Laboratori Nazionali del Sud, V.S. Sofia, 44 Cantania, Italy, Jan. 2010, 17 pages.
Dahl P, "Superconducting Magnet System," American Institute of Physics, AIP Conference Proceedings, 1987-1988, 2: 1329-1376.
Dialog Search, Jan. 31, 2005, 17 pages.
Dugan et al., "Tevatron Status" IEEE, Particle Accelerator Conference, Accelerator Science & Technology, 1989, pp. 426-430.
Eickhoff et al., "The Proposed Accelerator Facility for Light Ion Cancer Therapy in Heidelberg," Proceedings of the 1999 Particle Accelerator Conference, New York, 1999, pp. 2513-2515.
Enchevich et al., "Minimizing Phase Losses in the 680 MeV Synchrocyclotron by Correcting the Accelerating Voltage Amplitude," *Atomnaya Energiya*, 1969, 26:(3):315-316.
Endo et al., "Compact Proton and Carbon Ion Synchrotrons for Radiation Therapy," Proceedings of EPAC 2002, Paris France, 2002, pp. 2733-2735.
European Communication issued in corresponding European application No. 11165422.4, dated Sep. 2, 2011, 5 pages.
European Communication issued in European application No. 07868958.5, dated Nov. 26, 2010, 50 pages.
European Patent Office communication issued in European application No. 08856764.9, dated Jul. 30, 2010, 2 pages.
European Patent Office communicationissued in European application No. 07868958.5, dated Jul. 16, 2010, 2 pages.
European Search Report issued in European Application No. 11165423.2, dated Aug. 8, 2011, 118 pages.
Flanz et al., "Treating Patients with the NPTC Accelerator Based Proton Treatment Facility," Proceedings of the 2003 Particle Accelerator Conference, 2003, pp. 690-693.
Flanz et al., "Large Medical Gantries," Particle Accelerator Conference, Massachusetts General Hospital, 1995, pp. 1-5.
Flanz et al., "Operation of a Cyclotron Based Proton Therapy Facility", Massachusetts General Hospital, Boston, MA 02114, pp. 1-4, retrieved from Internet in 2009.
Flanz et al., "The Northeast Proton Therapy Center at Massachusetts General Hospital," Fifth Workshop on Heavy Charge Particles in Biology and Medicine, GSI, Darmstadt, Aug. 1995, 11 pages.
Flanz, et al., "Scanning Beam Technologies", PTCOG 2008, 28 pages.
Flood and Frazier,. "The Wide-Band Driven RF System for the Berkeley 88-Inch Cyclotron," American Institute of Physics, Conference Proceedings., No. 9, 1972, 459-466.
Foster and Kashikhin, "Superconducting Superferric Dipole Magent with Cold Iron Core for the VLHC," *IEEE Transactions on Applied Superconductivity*, Mar. 2002, 12(1):111-115.
Friesel et al., "Design and Construction Progress on the IUCF Midwest Proton Radiation Institute," Proceedings of EPAC 2002, 2002, pp. 2736-2738.
Fukumoto et al., "A Proton Therapy Facility Plan" Cyclotrons and their Applications, Proceedings of the 13th International Conference, Vancouver, Canada, Jul. 6-10, 1992, pp. 258-261.
Fukumoto, "Cyclotron Versus Synchrotron for Proton Beam Therapy," KEK Prepr., No. 95-122, 995, pp. 533-536.
Goto et al., "Progress on the Sector Magnets for the Riken SRC," American Institute of Physics, CP600, Cyclotrons and Their Applications 2001, Sixteenth International Conference, 2001, pp. 319-323.
Graffman et al., "Design Studies for a 200 MeV Proton Clinic for Radiotherapy," AIP Conference Proceedings: Cyclotrons—1972, 1972, No. 9, pp. 603-615.
Graffman et al., *Acta Radiol. Therapy Phys. Biol.* 1970, 9, 1 (1970).
Graffman, et. al. "Proton radiotherapy with the Uppsala cyclotron. Experience and plans" *Strahlentherapie*, 1985, 161(12):764-770.
Hede, "Research Groups Promoting Proton Therapy "Lite,"" Journal of the National Cancer Institute, Dec. 6, 2006, 98(23):1682-1684.
Heinz, "Superconducting Pulsed Magnetic Systems for High-Energy Synchrotrons," *Proceedings of the Fourth International Cryogenic Engineering Conference*, May 24-26, 1972, pp. 55-63.
Hentschel et al., "Plans for the German National Neutron Therapy Centre with a Hospital-Based 70 MeV Proton Cyclotron at University Hospital Essen/Germany," Cyclotrons and their Applications, Proceedings of the Fifteenth International Conference on Cyclotrons and their Applications, Caen, Franco, Jun. 14-19, 1998, pp. 21-23.
Hepburn et al., "Superconducting Cyclotron Neutron Source for Therapy," *International Journal of Radiation Oncology Biology Physics*, vol. 3 complete, 1977, pp. 387-391.
Hirabayashi, "Development of Superconducting Magnets for Beam Lines and Accelerator at KEK," *IEEE Transaction on Magnetics*, Jan. 1981, Mag-17(1):728-731.
International Preliminary Report on Patentability issued in PCT Application No. PCT/US2008/084695, dated Jun. 10, 2010, 10 pages.
International Preliminary Report on Patentability issued in PCT Application No. PCT/US2008/084699, dated Jun. 10, 2010, 8 pages.
International Preliminary Report on Patentability issued in PCT Application No. PCT/US2007/086109, dated Jun. 10, 2010, 7 pages.
International Preliminary Report on Patentability in Internation Application No. PCT/US2006/44853, dated May 29, 2008, 8 pages.
International Preliminary Report on Patentability in Internation Application No. PCT/US2007/001506, dated Jul. 5, 2007, 15 pages.
International Preliminary Report on Patentability in Internation Application No. PCT/US2007/001628, dated Apr. 22, 2008, 15 pages.
International Search Report and Written Opinion in International Application No. PCT/US2006/44853, dated Oct. 5, 2007, 3 pages.
International Search Report and Written Opinion in International Application No. PCT/US2007/001506, dated Jul. 5, 2007, Publication No. WO2007/084701, Published Jul. 26, 2007, 14 pages.
International Preliminary Report on Patentability on International Application No. PCT/US2008/077513, dated Apr. 22, 2010.
International Search Report and Written Opinion in International Application No. PCT/US2008/077513, dated Oct. 1, 2009, 73 pages.
International Search Report and Written Opinion in International Application No. PCT/US2008/084695, dated Jan. 26, 2009, 15 pages.
International Search Report in International Application No. PCT/US2007/001628, dated Feb. 18, 2008, 4 pages.
International Search Report and Written Opinion in International Application No. PCT/US2007/086109, dated Aug. 26, 2008, 6 pages.
International Search Report and Written Opinion in International Application No. PCT/US2008/084699, dated Feb. 4, 2009, 11 pages.
Ishibashi and McInturff, "Winding Design Study of Superconducting 10 T Dipoles for a Synchrotron," *IEEE Transactions on Magnetics*, May 1983, MAG-19(3):1364-1367.
Ishibashi and McInturff, "Stress Analysis of Superconducting 10T Magnets for Synchrotron," Proceedings of the Ninth International Cryogenic Engineering Conference, May 11-14, 1982, pp. 513-516.
Jahnke et al., "First Superconducting Prototype Magnets for a Compact Synchrotron Radiation Source in Operation," *IEEE Transactions on Magnetics*, Mar. 1988, 24(2):1230-1232.
Jones and Dershem, "Synchrotron Radiation from Proton in a 20 TEV, 10 TESLA Superconducting Super Collide,r" *Proceedings of the 12th International Conference on High-Energy Accelerator*, Aug. 11-16, 1983, pp. 138-140.
Jones and Mills, "The South African National Accelerator Centre: Particle Therapy and Isotope Production Programmes," *Radiation Physics and Chemistry*, Apr.-Jun. 1998, 51(4-6):571-578.
Jones et al., "Status Report of the NAC Particle Therapy Programme," *Stralentherapie und Onkologie*, vol. 175, Suppl. II, Jun. 1999, pp. 30-32.
Jones, "Progress with the 200 MeV Cyclotron Facility at the National Accelerator Centre," Commission of the European Communities Radiation Protection Proceedings, Fifth Symposium on Neutron Dosimetry, Sep. 17-21, 1984, vol. II, pp. 989-998.

(56) References Cited

OTHER PUBLICATIONS

Jones, "Present Status and Future Trends of Heavy Particle Radiotherapy," Cyclotrons and their Applications 1998, Proceedings of the Fifteenth International Conference on Cyclotrons and their Applications, Jun. 14-19, 1998, pp. 13-20.
Jongen et al., "Development of a Low-cost Compact Cyclotron System for Proton Therapy," *National Institute of Radiol Sci*, 1991, No. 81, pp. 189-200.
Jongen et al., "Progress report on the IBA-SHI small cyclotron for cancer therapy" *Nuclear Instruments and Methods in Physics Research*, Section B, vol. 79, issue 1-4, 1993, pp. 885-889.
Jongent et al., "The proton therapy system for the NPTC: Equipment Description and progress report," *Nuclear Instruments and methods in physics research*, 1996, Section B, 113(1): 522-525.
Jongen et al., "The proton therapy system for MGH's NPTC: equipment description and progress report," *Bulletin du Cancer/Radiotherapie, Proceedings of the meeting of the European Heavy Particle Therapy Group*, 1996, 83(Suppl. 1):219-222.
Kanai et al., "Three-dimensional Beam Scanning for Proton Therapy," Nuclear Instruments and Methods in Physic Research, Sep. 1, 1983, The Netherlands, 214(23):491-496.
Karlin et al., "Medical Radiology" (Moscow), 1983, 28, 13.
Karlin et al., "The State and Prospects in the Development of the Medical Proton Tract on the Synchrocyclotron in Gatchina," *Med. Radiol*., Moscow, 28(3):28-32 (Mar. 1983)(German with English Abstract on end of p. 32).
Kats and Druzhinin, "Comparison of Methods for Irradiation Prone Patients," *Atomic Energy*, Feb. 2003, 94(2):120-123.
Kats and Onosovskii, "A Simple, Compact, Flat System for the Irradiation of a Lying Patient with a Proton Beam from Different Directions," *Instruments and Experimental Techniques*, 1996, 39(1): 132-134.
Kats and Onosovskii, "A Planar Magnetooptical System for the Irradiation of a Lying Patient with a Proton Beam from Various Directions," *Instruments and Experimental Techniques*, 1996, 39(1):127-131.
Khoroshkov et al.,"Moscow Hospital-Based Proton Therapy Facility Design," *Am. Journal Clinical Oncology: CCT*, Apr. 1994, 17(2):109-114.
Kim and Blosser, "Optimized Magnet for a 250 MeV Proton Radiotherapy Cyclotron," Cyclotrons and Their Applications 2001, May 2001, *Sixteenth International Conference*, pp. 345-347.
Kim and Yun, "A Light-Ion Superconducting Cyclotron System for Multi-Disciplinary Users," *Journal of the Korean Physical Society*, Sep. 2003, 43(3):325-331.
Kim et al., "Construction of 8T Magnet Test Stand for Cyclotron Studies," *IEEE Transactions on Applied Superconductivity*, Mar. 1993, 3(1):266-268.
Kim et al., "Design Study of a Superconducting Cyclotron for Heavy Ion Therapy," *Cyclotrons and Their Applications 2001, Sixteenth International Conference*, May 13-17, 2001, pp. 324-326.
Kim et al., "Trim Coil System for the Riken Cyclotron Ring Cyclotron," *Proceedings of the 1997 Particle Accelerator Conference, IEEE*, Dec. 1981, vol. 3, pp. 214-235 OR 3422-3424, 1998.
Kim, "An Eight Tesla Superconducting Magnet for Cyclotron Studies," Ph.D. Dissertation, Michigan State University, Department of Physics and Astronomy, 1994, 138 pages.
Kimstrand, "Beam Modelling for Treatment Planning of Scanned Proton Beams," Digital Comprehensive Summaries of Uppsala dissertations from the Faculty of Medicine 330, Uppsala Universitet, 2008, 58 pages.
Kishida and Yano, "Beam Transport System for the RIKEN SSC (II)," *Scientific Papers of the Institute of Physical and Chemical Research*, Dec. 1981, 75(4):214-235.
Koehler et al., "Range Modulators for Protons and Heavy Ions," *Nuclear Instruments and Methods*, 1975, vol. 131, pp. 437-440.
Koto and Tsujii, "Future of Particle Therapy," *Japanese Journal of Cancer Clinics*, 2001, 47(1):95-98 [Lang.: Japanese], English abstract (http://sciencelinks.jp/j-east/article/200206/000020020601A0511453.php).
Kraft et al., "Hadrontherapy in Oncology," U. Amaldi and Lamson, editors Elsevier Science, 1994, 390 pages.
Krevet et al., "Design of a Strongly Curved Superconducting Bending Magnet for a Compact Synchrotron Light Source," *Advances in Cryogenic Engineering*, 1988, vol. 33, pp. 25-32.
Laisne et al., "The Orsay 200 MeV Synchrocyclotron," *IEEE Transactions on Nuclear Science*, Apr. 1979, NS-26(2):1919-1922.
Larsson et al., *Nature*, 1958, 182:1222.
Larsson, "Biomedical Program for the Converted 200-MeV Synchrocyclotron at the Gustaf Werner Institute," *Radiation Research*, 1985, 104:S310-S318.
Lawrence et al., "Heavy particles in acromegaly and Cushing's Disease," in Endocrine and Norendocrine Hormone Producing Tumors (Year Book Medical Chicago, 1973, pp. 29-61.
Lawrence et al., "Successful Treatment of Acromegaly: Metabolic and Clinical Studies in 145 Patients," *The Journal of Clinical Endrocrinology and Metabolism*, Aug. 1970, 31(2), 21 pages.
Lawrence et al., "Treatment of Pituitary Tumors," (Excerpta medica, Amsterdam/American Elsevier, New York, 1973, pp. 253-262.
Lawrence, *Cancer*, 1957, 10:795.
Lecroy et al., "Viewing Probe for High Voltage Pulses," *Review of Scientific Instruments USA*, Dec. 1960, 31(12):1354.
Lin et al., "Principles and 10 Year Experience of the Beam Monitor System at the PSI Scanned Proton Therapy Facility", Center for Proton Radiation Therapy, Paul Scherrer Institute, CH-5232, Villigen PSI, Switzerland, 2007, 21 pages.
Linfoot et al., "Acromegaly," in Hormonal Proteins and Peptides, edited by C.H. Li, 1975, pp. 191-246.
Literature Author and Keyword Search, Feb. 14, 2005, 44 pages.
Literature Keyword Search, Jan. 24, 2005, 96 pages.
Literature Search and Keyword Search for Synchrocyclotron, Jan. 25, 2005, 68 pages.
Literature Search by Company Name/Component Source, Jan. 24, 2005, 111 pages.
Literature Search, Jan. 26, 2005, 36 pages.
Livingston et al., "A capillary ion source for the cyclotron," *Review Science Instruments*, Feb. 1939, 10:63.
Mandrillon, "High Energy Medical Accelerators," *EPAC 90, 2nd European Particle Accelerator Conference*, Jun. 12-16, 1990, 2:54-58.
Marchand et al., "1EA Proton Pencil Beam Scanning: an Innovative Solution for Cancer Treatment," Proceedings of EPAC 2000, Vienna, Austria, 3 pages.
Marti et al., "High Intensity Operation of a Superconducting Cyclotron," *Proceedings of the 14the International Conference, Cyclotrons and Their Applications*, Oct. 1995, pp. 45-48 (Oct. 1995).
Martin, "Operational Experience with Superconducting Synchrotron Magnets" *Proceedings of the 1987 IEEE Particle Accelerator Conference*, Mar. 16-19, 1987, vol. 3 of 3:1379-1382.
Meote et al., "ETOILE Hadrontherapy Project, Review of Design Studies" *Proceedings of EPAC* 2002, 2002, pp. 2745-2747.
Miyamoto et al., "Development of the Proton Therapy System," *The Hitachi Hyoron*, 79(10):775-779 (1997) [Lang: Japanese], English abstract (http://www.hitachi.com/rev/1998/revfeb98/rev4706.htm).
Montelius et al., "The Narrow Proton Beam Therapy Unit at the Svedberg Laboratory in Uppsala," *ACTA Oncologica*, 1991, 30:739-745.
Moser et al., "Nonlinear Beam Optics with Real Fields in Compact Storage Rings," Nuclear Instruments & Methods in Physics Research/Section B, B30, Feb. 1988, No. 1, pp. 105-109.
Moyers et al., "A Continuously Variable Thickness Scatterer for Proton Beams Using Self-compensating Dual Linear Wedges" Lorna Linda University Medical Center, Dept. of Radiation Medicine, Lorna Linda, CA, Nov. 2, 1992, 21 pages.
National Cancer Institute Funding (Senate-Sep. 21, 1992) (www.thomas.loc.gov/cgi-bin/query/z?r102:S21SE2-712 (2 pages).
Nicholson, "Applications of Proton Beam Therapy," *Journal of the American Society of Radiologic Technologists*, May/Jun. 1996, 67(5): 439-441.
Nolen et al., "The Integrated Cryogenic—Superconducting Beam Transport System Planned for MSU," *Proceedings of the 12th International Conference on High-Energy Accelerators*, Aug. 1983, pp. 549-551.

(56) References Cited

OTHER PUBLICATIONS

Norimine et al., "A Design of a Rotating Gantry with Easy Steering for Proton Therapy," *Proceedings of EPAC* 2002, 2002, pp. 2751-2753.
Ogino, Takashi, "Heavy Charged Particle Radiotherapy-Proton Beam", Division of Radiation Oncology, National Cancer Hospital East, Kashiwa, Japan, Dec. 2003, 7 pages.
Okumura et al., "Overview and Future Prospect of Proton Radiotherapy," *Japanese Journal of Cancer Clinics*, 1997, 43(2):209-214 [Lang.: Japanese].
Okumura et al., "Proton Radiotherapy" *Japanese Journal of Cancer and Chemotherapy*, 1993, 10.20(14):2149-2155[Lang.: Japanese].
Outstanding from Search Reports, "Accelerator of Polarized Portons at Fermilab," 2005, 20 pages.
Paganetti et al., "Proton Beam Radiotherapy—The State of the Art," Springer Verlag, Heidelberg, ISBN 3-540-00321-5, Oct. 2005, 36 pages.
Palmer and Tollestrup, "Superconducting Magnet Technology for Accelerators," *Annual Review of Nuclear and Particle Science*, 1984, vol. 34, pp. 247-284.
Patent Assignee and Keyword Searches for Synchrocyclotron, Jan. 25, 2005, 77 pages.
Pavlovic, "Beam-optics study of the gantry beam delivery system for light-ion cancer therapy," *Nuclear Instruments and Methods in Physics Research*, Section A, Nov. 1997, 399(2):439-454(16).
Pedroni and Enge, "Beam optics design of compact gantry for proton therapy" *Medical & Biological Engineering & Computing*, May 1995, 33(3):271-277.
Pedroni and Jermann,. "SGSMP: Bulletin Mar. 2002 Proscan Project, Progress Report on the PROSCAN Project of PSI" [online] retrieved from www.sgsmp.ch/protA23.htm, Mar. 2002, 5 pages.
Pedroni et al., "A Novel Gantry for Proton Therapy at the Paul Scherrer Institute," *Cycloctrons and Their Applications 2001: Sixteenth International Conference. AIP Conference Proceedings*, 2001, 600:13-17.
Pedroni et al., "The 200-MeV proton therapy project at the Paul Scherrer Institute: Conceptual design and practical realization," *Medical Physics*, Jan. 1995, 22(1):37-53.
Pedroni, "Accelerators for Charged Particle Therapy: Performance Criteria from the User Point of View," *Cyclotrons and their Applications, Proceedings of the 13th International Conference*, Jul. 6-10, 1992, pp. 226-233.
Pedroni, "Latest Developments in Proton Therapy" *Proceedings of EPAC* 2000, 2000, pp. 240-244.
Pedroni, "Status of Proton Therapy: results and future trends," Paul Scherrer Institute, Division of Radiation Medicine, 1994, 5 pages.
Peggs et al., "A Survey of Hadron Therapy Accelerator Technologies," Particle Accelerator Conference, Jun. 25-29, 2007, 7 pages.
Potts et al., "MPWP6-Therapy III: Treatment Aids and Techniques" *Medical Physics*, Sep./Oct. 1988, 15(5):798.
Pourrahimi et al., "Powder Metallurgy Processed Nb3Sn(Ta) Wire for High Field NMR magnets," *IEEE Transactions on Applied Superconductivity*, Jun. 1995, 5(2):1603-1606.
Prieels et al., "The IBA State-of-the-Art Proton Therapy System, Performances and Recent Results," *Application of Accelerators in Research and industry—Sixteenth Int'l. Conf., American Institute of Physics*, Nov. 1-5, 2000, 576:857-860.
Rabin et al., "Compact Designs for Comprehensive Proton Beam Clinical Facilities," *Nuclear Instruments & Methods in Physics Research*, Apr. 1989, Section B, vol. 40-41, Part II, pp. 1335-1339.
*Research & Development Magazine*, "Proton Therapy Center Nearing Completion," Aug. 1999, 41(9):2 pages, (www.rdmag.com).
Resmini, "Design Characteristics of the K=800 Superconducting Cyclotron at M.S.U.," Cyclotron Laboratory, Michigan State University, East Lansing, Michigan 48824, IEEE Transaction on Nuclear Science, vol. NS-26, No. 2, Apr. 1979, 8 pages.
RetroSearch "Berkeley 88-Inch Cyclotron 'RF' or 'Frequency Control'," Jan. 21, 2005, 36 pages.
RetroSearch "Berkeley 88-Inch Cyclotron," Jan. 24, 2005, 170 pages.
RetroSearch "Bernard Gottschalk, Cyclotron, Beams, Compensated Upstream Modulator, Compensated Scatter," Jan. 21, 2005, 20 pages.
RetroSearch "Cyclotron with 'RF' or 'Frequency Control'," Jan. 21, 2005, 49 pages.
RetroSearch Gottschalk, Bernard, Harvard Cyclotron Wheel, Jan. 21, 2005, 20 pages.
RetroSearch "Loma Linda University Beam Compensation," Jan. 21, 2005, 60 pages.
RetroSearch "Loma Linda University, Beam Compensation Foil Wedge," Jan. 21, 2005, 15 pages.
Revised Patent Keyword Search, Jan. 25, 2005, 88 pages.
Rifuggiato et, al., "Status Report of the LNS Superconducting Cyclotron" *Nukleonika*, 2003, 48: S131-S134, Supplement 2.
Rode, "Tevatron Cryogenic System," *Proceedings of the 12th International Conference on High-energy Accelerators, Fermilab*, Aug. 11-16, 1983, pp. 529-535.
Salzburger et al., "Superconducting Synchrotron Magnets Supraleitende Synchrotronmagnete," Siemens A.G., Erlangen (West Germany). Abteilung Technische Physik, Report No. BMFT-FB-T-75-25, Oct. 1975, p. 147, Journal Announcement: GRAI7619; STAR1415, Subm-Sponsored by Bundesmin. Fuer Forsch. U. Technol. In German; English Summary.
Schillo et al,. "Compact Superconducting 250 MeV Proton Cyclotron for the PSI Proscan Proton Therapy Project," *Cyclotrons and Their Applications 2001, Sixteenth International Conference*, 2001, pp. 37-39.
Schneider et al., "Nevis Synchrocyclotron Conversion Program—RF System," *IEEE Transactions on Nuclear Science USA*, Jun. 1969, ns. 16(3): 430-433.
Schneider et al., "Superconducting Cyclotrons," IEEE Transactions on Magnetics, vol. MAG-11, No. 2, Mar. 1975, New York, pp. 443-446.
Schreuder et al., "The Non-orthogonal Fixed Beam Arrangement for the Second Proton Therapy Facility at the National Accelerator Centre," *Application of Accelerators in Research and Industry, American Institute of Physics, Proceedings of the Fifteenth International Conference*, Nov. 1998, Part Two, pp. 963-966.
Schreuder, "Recent Developments in Superconducting Cyclotrons," *Proceedings of the 1995 Particle Accelerator Conference*, May 1-5, 1995, vol. 1, pp. 317-321.
Schubert and Blosser, "Conceptual Design of a High Field Ultra-Compact Cyclotron for Nuclear Physics Research," *Proceedings of the 1997 Particle Accelerator Conference*, May 12-16, 1997, vol. 1, pp. 1060-1062.
Schubert, "Extending the Feasibility Boundary of the Isochronous Cyclotron," Dissertation submitted to Michigan State University, 1997, Abstract http://adsabs.harvard.edu/abs/1998PhDT . . . 147S.
Shelaev et al., "Design Features of a Model Superconducting Synchrotron of JINR," *Proceedings of the 12th International Conference on High-energy Accelerators*, Aug. 11-16, 1983, pp. 416-418.
Shintomi et. Al, "Technology and Materials for the Superconducting Super Collider (SSC) Project," [Lang.: Japanese], The Iron and Steel Institute of Japan 00211575, 78(8): 1305-1313, 1992, http://ci.nii.ac.jp/naid/110001493249/en/.
Sisterson, "World Wide Proton Therapy Experience in 1997," *The American Insitute of Physics, Applications of Accelerators in Research and Industry, Proceedings of the Fifteenth International Conference*, Part Two, Nov. 1998, pp. 959-962.
Sisterson, "Clinical use of proton and ion beams from a world-wide perspective," *Nuclear Instruments and Methods in Physics Research*, Section B, 1989, 40-41:1350-1353.
Slater et al., "Developing a Clinical Proton Accelerator Facility: Consortium-Assisted Technology Transfer," *Conference Record of the 1991 IEEE Particle Accelerator Conference: Accelerator Science and Technology*, vol. 1, May 6-9, 1991, pp. 532-536.
Slater et al., "Development of a Hospital-Based Proton Beam Treatment Center," *International Journal of Radiation Oncology Biology Physics*, Apr. 1988, 14(4):761-775.
Smith et al., "The Northeast Proton Therapy Center at Massachusetts General Hospital" *Journal of Brachytherapy International*, Jan. 1997, pp. 137-139.

(56) References Cited

OTHER PUBLICATIONS

Snyder and Marti, "Central region design studies for a proposed 250 MeV proton cyclotron," *Nuclear Instruments and Methods in Physics Research*, Section A, 1995, vol. 355, pp. 618-623.
Soga, "Progress of Particle Therapy in Japan," Application of Accelerators in Research and Industry, American Institute of Physics, Sixteenth International Conference, Nov. 2000, pp. 869-872.
Spiller et al., "The GSI Synchrotron Facility Proposal for Acceleration of High Intensity Ion and Proton Beams" *Proceedings of the 2003 Particle Accelerator Conference*, May 12-16, 2003, vol. 1, pp. 589-591.
Stanford et al., "Method of Temperature Control in Microwave Ferroelectric Measurements," Sperry Microwave Electronics Company, Clearwater, Florida, Sep. 19, 1960, 1 page.
Tadashi et al., "Large superconducting super collider (SSC) in the planning and materials technology," 1992, 78(8):1305-1313, The Iron and Steel Institute of Japan 00211575.
Takada, "Conceptual Design of a Proton Rotating Gantry for Cancer Therapy," *Japanese Journal of Medical Physics*, 1995, 15(4):270-284.
Takayama et al., "Compact Cyclotron for Proton Therapy," *Proceedings of the 8th Symposium on Accelerator Science and Technology*, Japan, Nov. 25-27, 1991, pp. 380-382.
Teng, "The Fermilab Tevatron," Coral Gables 1981, Proceedings, Gauge Theories, Massive Neutrinos, and Proton Decay, 1981, pp. 43-62.
The Journal of Practical Pharmacy, 1995, 46(1):97-103 [Japanese].
Tilly et al., "Development and verification of the pulsed scanned proton beam at The Svedberg Laboratory in Uppsala," *Phys. Med. Biol.*, 2007, 52:2741-2754.
Tobias et al., *Cancer Research*, 1958, 18, 121 (1958).
Tom, "The Use of Compact Cyclotrons for Producing Fast Neutrons for Therapy in a Rotatable Isocentric Gantry," *IEEE Transaction on Nuclear Science*, Apr. 1979, 26(2):2294-2298.
Toyoda, "Proton Therapy System", Sumitomo Heavy Industries, Ltd., 2000, 5 pages.
Trinks et. al., "The Tritron: A Superconducting Separated-Orbit Cyclotron," *Nuclear Instruments and Methods in Physics Research*, Section A, 1986, vol. 244, pp. 273-282.
Tsuji, "The Future and Progress of Proton Beam Radiotherapy," *Journal of Japanese Society for Therapeutic Radiology and Oncology*, 1994, 6(2):63-76.
UC Davis School of Medicine, "Unlikely Partners Turn Military Defense into Cancer Offense", Current Issue Summer 2008, Sacramento, California, pp. 1-2.
Umegaki et al., "Development of an Advanced Proton Beam Therapy System for Cancer Treatment" *Hitachi Hyoron*, 2003, 85(9):605-608 [Lang.: Japanese], English abstract, http://www.hitachi.com/ICSFiles/afieldfile/2004/06/01/r2003_04_104.pdf or http://www.hitachi.com/rev/archive/2003/2005649_12606.html (full text) [Hitachi, 52(4), Dec. 2003].
Umezawa et al., "Beam Commissioning of the new Proton Therapy System for University of Tsukuba," *Proceedings of the 2001 Particle Accelerator Conference*, vol. 1, Jun. 18-22, 2001, pp. 648-650.
van Steenbergen, "Superconducting Synchroton Development at BNL," *Proceedings of the 8th International Conference on High-Energy Accelerators CERN* 1971, 1971, pp. 196-198.
van Steenbergen, "The CMS, a Cold Magnet Synchrotron to Upgrade the Proton Energy Range of the BNL Facility," *IEEE Transactions on Nuclear Science*, Jun. 1971, 18(3):694-698.
Vandeplassche et al., "235 MeV Cyclotron for MGH's Northeast Proton Therapy Center (NPTC): Present Status," EPAC 96, *Fifth European Partical Accelerator Conference*, vol. 3, Jun. 10-14, 1996, pp. 2650-2652.
Vorobiev et al., "Concepts of a Compact Achromatic Proton Gantry with a Wide Scanning Field", Nuclear Instruments and Methods in Physics Research, Section A., 1998, 406(2):307-310.
Vrenken et al., "A Design of a Compact Gantry for Proton Therapy with 2D-Scanning," *Nuclear Instruments and Methods in Physics Research*, Section A, 1999, 426(2):618-624.
Wikipedia, "Cyclotron" http://en.wikipedia.org/wiki/Cyclotron (originally visited Oct. 6, 2005, revisited Jan. 28, 2009), 7 pages.
Wikipedia, "Synchrotron" http://en.wikipedia.org/wiki/Synchrotron (originally visited Oct. 6, revisited Jan. 28, 2009), 7 pages.
Worldwide Patent Assignee Search, Jan. 24, 2005, 224 pages.
Worldwide Patent Keyword Search, Jan. 24, 2005, 94 pages.
Written Opinion in PCT Application No. PCT/US2007/001628, dated Feb. 18, 2008, 11 pages.
Wu, "Conceptual Design and Orbit Dynamics in a 250 MeV Superconducting Synchrocyclotron," Ph.D. Dissertation, Michigan State University, Department of Physics and Astronomy, 1990, 172 pages.
York et al., "Present Status and Future Possibilities at NSCL-MSU," EPAC 94, Fourth European Particle Accelerator Conference, pp. 554-556, Jun. 1994.
York et al., "The NSCL Coupled Cyclotron Project—Overview and Status,"*Proceedings of the Fifteenth International Conference on Cyclotrons and their Applications*, Jun. 1998, pp. 687-691.
Yudelev et al., "Hospital Based Superconducting Cyclotron for Neutron Therapy: Medical Physics Perspective," *Cyclotrons and their applications 2001, 16th International Conference. American Institute of Physics Conference Proceedings*, vol. 600, May 13-17, 2001, pp. 40-43.
Zherbin et al., "Proton Beam Therapy at the Leningrad Synchrocyclotron (Clinicomethodological Aspects and Therapeutic Results)", Aug. 1987, 32(8):17-22, (German with English abstract on pp. 21-22).
U.S. Appl. No. 13/949,459, filed Jul. 24, 2013.
U.S. Appl. No. 13/830,792, filed Mar. 14, 2013.
U.S. Appl. No. 61/676,377, filed Jul. 27, 2012.
U.S. Appl. No. 13/949,450, filed Jul. 24, 2013.
U.S. Appl. No. 13/838,792, filed Mar. 14, 2013.

* cited by examiner

ACTIVE RETURN SYSTEM

TECHNICAL FIELD

This disclosure relates generally to an active return system for a superconducting magnet.

BACKGROUND

Particle therapy systems use an accelerator to generate a particle beam for treating afflictions, such as tumors. In operation, particles are accelerated in orbits inside a cavity in the presence of a magnetic field, and removed from the cavity through an extraction channel. The particles are part of a beam, which is applied to the patient for treatment. The magnetic field is generated by a magnet, which produces magnetic flux. Too much stray magnetic flux can adversely affect the operation of the accelerator and of other components of the particle therapy system. A return may therefore be used to route the stray magnetic flux. Ferromagnetic returns can be heavy, and add considerable weight to the accelerator. This can be problematic in some cases.

SUMMARY

An example particle accelerator comprises a magnet to generate a magnetic field, where the magnet comprises first superconducting coils to pass current in a first direction to thereby generate the first magnetic field, and where the first magnetic field is at least 4 Tesla (T). The example particle accelerator also comprises an active return system including second superconducting coils. Each of the second superconducting coils surrounds, and is concentric with, a corresponding first superconducting coil. The second superconducting coils are for passing current in a second direction that is opposite to the first direction to thereby generate a second magnetic field having a magnetic field of at least 2.5 T. The second magnetic field has a polarity that is opposite to a polarity of the first magnetic field. The example particle accelerator may include one or more of the following features, either alone or in combination.

A power supply may provide current to both the first superconducting coils and the second superconducting coils. The first superconducting coils and the second superconducting coils may be mounted on a structure. The structure may comprise at least one of stainless steel and carbon fiber.

The first superconducting coils may be mounted on an interior of the structure and the second superconducting coils may be mounted on an exterior of the structure such that the second superconducting coils are separated from the first superconducting coils by at least part of the structure. A banding ring may be around the second superconducting coils.

Magnetic pole pieces may define the cavity, and the structure may be around at least part of the magnetic pole pieces. A cryostat cover may be around at least part of the structure and at least part of the magnetic pole pieces. The cryostat cover may comprise a non-ferromagnetic material.

The particle accelerator may weigh less than 15 tons, less than 10 tons, less than 9 tons, less than 8 tons, less than 7 tons, and so forth.

A proton therapy system may comprise the foregoing particle accelerator (and variations thereof), along with a gantry on which the particle accelerator is mounted. The gantry is rotatable relative to a patient position. Protons are output essentially directly from the particle accelerator to the patient position. The particle accelerator may be a synchrocyclotron.

The proton therapy system may also comprise a particle source to provide ionized plasma to a cavity containing the first magnetic field and a voltage source to provide voltage to accelerate a beam comprised of pulses of ionized plasma towards an exit.

An example particle accelerator may comprise a voltage source to provide a radio frequency (RF) voltage to a cavity to accelerate particles to produce a particle beam, where the cavity has a first magnetic field for causing particles accelerated from the plasma column to move orbitally within the cavity, and where the RF voltage is controllable to vary in time as the particle beam increases in distance from the plasma column. The example particle accelerator may also comprise a magnet to generate the first magnetic field in the cavity, where the magnet comprises first superconducting coils to pass current in a first direction to thereby generate the first magnetic field. The example particle accelerator may also comprise an active return system comprising second superconducting coils, where each of the second superconducting coils surrounds, and is concentric with, a corresponding first superconducting coil. The second superconducting coils are for passing current in a second direction that is opposite to the first direction to thereby generate a second magnetic field having a magnetic field of at least 2.5 Tesla (T). The second magnetic field has a polarity that is opposite to a polarity of the first magnetic field. The example particle accelerator may include one or more of the following features, either alone or in combination.

The first magnetic field may be least 4 T. The second magnetic field may be at between 2.5 T and 12 T. The first magnetic field may be between 4 T and 20 T and the second magnetic field may be between 2.5 T and 12 T.

A single power supply may be used to provide current to both the first superconducting coils and to the second superconducting coils. The first superconducting coils and the second superconducting coils may be mounted on a structure. The structure may comprise at least one of stainless steel and carbon fiber. The first superconducting coils may be mounted on an interior of the structure and the second superconducting coils may be mounted on an exterior of the structure such that the second superconducting coils are separated from the first superconducting coils by at least part of the structure. A banding ring may be around the second superconducting coils.

Magnetic pole pieces may define the cavity, and the structure may be around at least part of the magnetic pole pieces. A cryostat cover may be around at least part of the structure and at least part of the magnetic pole pieces. The cryostat cover may comprise a non-ferromagnetic material.

The particle accelerator may weigh less than 15 tons, less than 10 tons, less than 9 tons, less than 8 tons, less than 7 tons, and so forth.

A proton therapy system may comprise the foregoing particle accelerator (and variations thereof), along with a gantry on which the particle accelerator is mounted. The gantry is rotatable relative to a patient position. Protons are output essentially directly from the particle accelerator to the patient position. The particle accelerator may be a synchrocyclotron. The proton therapy system may also comprise a particle source to provide ionized plasma to a cavity containing the first magnetic field and a voltage source to provide voltage to accelerate a beam comprised of pulses of ionized plasma towards an exit.

Two or more of the features described in this disclosure, including those described in this summary section, may be combined to form implementations not specifically described herein.

Control of the various systems described herein, or portions thereof, may be implemented via a computer program product that includes instructions that are stored on one or more non-transitory machine-readable storage media, and that are executable on one or more processing devices. The systems described herein, or portions thereof, may be implemented as an apparatus, method, or electronic system that may include one or more processing devices and memory to store executable instructions to implement control of the stated functions.

The details of one or more implementations are set forth in the accompanying drawings and the description below. Other features, objects, and advantages will be apparent from the description and drawings, and from the claims.

DESCRIPTION OF THE DRAWINGS

Like reference symbols in the various drawings indicate like elements.

DETAILED DESCRIPTION

Described herein is an example of a particle accelerator for use in a system, such as a proton or ion therapy system. The example particle therapy system includes a particle accelerator—in this example, a synchrocyclotron—mounted on a gantry. The gantry enables the accelerator to be rotated around a patient position, as explained in more detail below. In some implementations, the gantry is steel and has two legs mounted for rotation on two respective bearings that lie on opposite sides of a patient. The particle accelerator is supported by a steel truss that is long enough to span a treatment area in which the patient lies and that is attached at both ends to the rotating legs of the gantry. As a result of rotation of the gantry around the patient, the particle accelerator also rotates.

In an example implementation, the particle accelerator (e.g., the synchrocyclotron) includes a cryostat that holds a superconducting coil for conducting a current that generates a magnetic field (B). In this example, the cryostat uses liquid helium (He) to maintain the coil at superconducting temperatures, e.g., 4° Kelvin (K). Magnetic pole pieces are located inside the cryostat, and define a cavity in which particles are accelerated.

In this example implementation, the particle accelerator includes a particle source (e.g., a Penning Ion Gauge—PIG source) to provide a plasma column to the cavity. Hydrogen gas is ionized to produce the plasma column. A voltage source provides a radio frequency (RF) voltage to the cavity to accelerate particles from the plasma column. As noted, in this example, the particle accelerator is a synchrocyclotron. Accordingly, the RF voltage is swept across a range of frequencies to account for relativistic effects on the particles (e.g., increasing particle mass) when accelerating particles from the column. The magnetic field produced by running current through the superconducting coil causes particles accelerated from the plasma column to accelerate orbitally within the cavity.

A magnetic field regenerator ("regenerator") is positioned near the outside of the cavity (e.g., at an interior edge thereof) to adjust the existing magnetic field inside the cavity to thereby change locations (e.g., the pitch and angle) of successive orbits of the particles accelerated from the plasma column so that, eventually, the particles output to an extraction channel that passes through the cryostat. The regenerator may increase the magnetic field at a point in the cavity (e.g., it may produce a magnetic field "bump" at an area of the cavity), thereby causing each successive orbit of particles at that point to precess outwardly toward the entry point of the extraction channel until it reaches the extraction channel. The extraction channel receives particles accelerated from the plasma column and outputs the received particles from the cavity as a particle beam.

Figure 1:
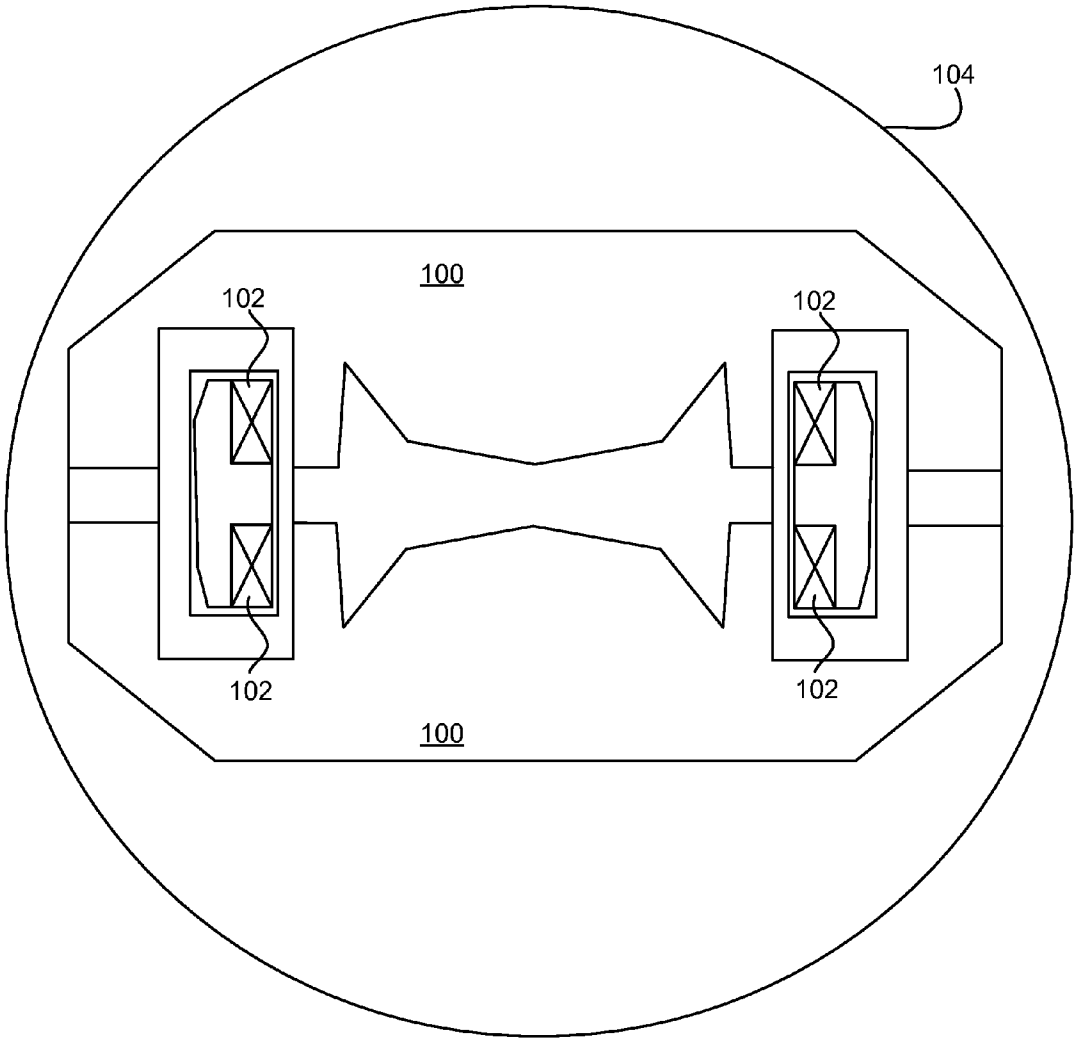
FIG. 1 is a side cut-away view of a superconducting magnet.

The superconducting coil can produce relatively high magnetic fields. Traditionally, large ferromagnetic magnetic yokes acted as a return for stray magnetic field produced by the superconducting coil. For example, in some implementations, the superconducting magnet can generate a relatively high magnetic field of, e.g., 4 Tesla (T) or more, resulting in considerable stray magnetic fields. In some systems, such as that shown in FIG. 1, relatively large ferromagnetic return yokes 100 were used as a return for the magnetic field generated by superconducting coils 102. A magnetic shield 104 surrounded the pole pieces. The return yokes and the shield together dissipated stray magnetic field, thereby reducing the possibility that stray magnetic fields would adversely affect the operation of the accelerator. Drawbacks of this configuration may include size and weight. For example, in some such systems, the accelerator could have a weight on the order of 25 tons or more with correspondingly large dimensions.

Figure 2:
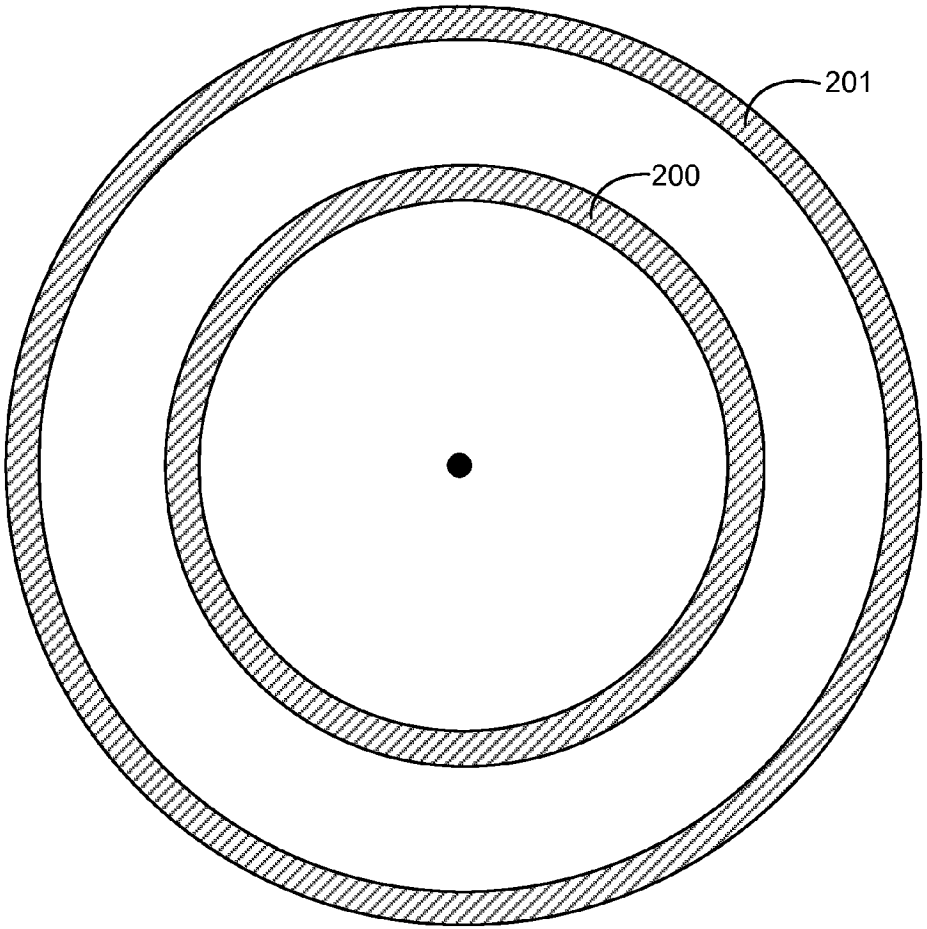
FIG. 2 is top view of example main and active return coils.

In some implementations, therefore, the relatively large yokes and shield used because of the relatively high magnetic field may be replaced by an active return system. An example active return system includes one or more active return coils that conduct current in a direction opposite to current through the main superconducting coils. In some example implementations, there is an active return coil for each superconducting coil, e.g., two active return coils—one for each superconducting coil (referred to as a "main" coil). Each active return coil may also be a superconducting coil that surrounds the outside of a corresponding main superconducting coil. For example, a main coil 200 and an active return coil 201 may be arranged concentrically, as shown in FIG. 2.

Current passes through the active return coils in a direction that is opposite to the direction of current passing through the main coils. The current passing through the active return coils thus generates a magnetic field that is opposite in polarity to the magnetic field generated by the main coils. As a result, the magnetic field generated by an active return coil is able to dissipate the relatively strong stray magnetic field resulting from the corresponding main coil. In some implementations, each active return may be used to generate a magnetic field of between 2.5 T and 12 T or more. For example, an active return coil may be used to generate magnetic fields at, or that exceed, one or more of the following magnitudes: 2.5 T, 2.6 T, 2.7 T, 2.8 T, 2.9 T, 3.0 T, 3.1 T, 3.2 T, 3.3 T, 3.4 T, 3.5 T, 3.6 T, 3.7 T, 3.8 T, 3.9 T, 4.0 T, 4.1 T, 4.2 T, 4.3 T, 4.4 T, 4.5 T, 4.6 T, 4.7 T, 4.8 T, 4.9 T, 5.0 T, 5.1 T, 5.2 T, 5.3 T, 5.4 T, 5.5 T, 5.6 T, 5.7 T, 5.8 T, 5.9 T, 6.0 T, 6.1 T, 6.2 T, 6.3 T, 6.4 T, 6.5 T, 6.6 T, 6.7 T, 6.8 T, 6.9 T, 7.0 T, 7.1 T, 7.2 T, 7.3 T, 7.4 T, 7.5, 7.6 T, 7.7 T, 7.8 T, 7.9 T, 8.0 T, 8.1 T, 8.2 T, 8.3 T, 8.4 T, 8.5, 8.6 T, 8.7 T, 8.8 T, 8.9 T, 9.0 T, 9.1 T, 9.2 T, 9.3 T, 9.4 T, 9.5, 9.6 T, 9.7 T, 9.8 T, 9.9 T, 10.0 T, 10.1 T, 10.2 T, 10.3 T, 10.4 T, 10.5, 10.6 T, 10.7 T, 10.8 T, 10.9 T, 11.0 T, 11.1 T, 11.2 T, 11.3 T, 11.4 T, 11.5, 11.6 T, 11.7 T, 11.8 T, 11.9 T, 12.0 T, 12.1 T, 12.2 T, 12.3 T, 12.4 T, 12.5, or more. Furthermore, an active return coil may be used to generate magnetic fields that are within the range of 2.5 T to 12 T (or more) that are not specifically listed above.

The magnetic field generated by a main coil that may be within a range of 4 T to 20 T or more. For example, a main coil may be used to generate magnetic fields at, or that exceed, one or more of the following magnitudes: 4.0 T, 4.1 T, 4.2 T, 4.3 T, 4.4 T, 4.5 T, 4.6 T, 4.7 T, 4.8 T, 4.9 T, 5.0 T, 5.1 T, 5.2 T, 5.3 T, 5.4 T, 5.5 T, 5.6 T, 5.7 T, 5.8 T, 5.9 T, 6.0 T, 6.1 T, 6.2 T, 6.3 T, 6.4 T, 6.5 T, 6.6 T, 6.7 T, 6.8 T, 6.9 T, 7.0 T, 7.1 T, 7.2 T, 7.3 T, 7.4 T, 7.5 T, 7.6 T, 7.7 T, 7.8 T, 7.9 T, 8.0 T, 8.1 T, 8.2 T, 8.3 T, 8.4 T, 8.5 T, 8.6 T, 8.7 T, 8.8 T, 8.9 T, 9.0 T, 9.1 T, 9.2 T, 9.3 T, 9.4 T, 9.5 T, 9.6 T, 9.7 T, 9.8 T, 9.9 T, 10.0 T, 10.1 T, 10.2 T, 10.3 T, 10.4 T, 10.5 T, 10.6 T, 10.7 T, 10.8 T, 10.9 T, 11.0 T, 11.1 T, 11.2 T, 11.3 T, 11.4 T, 11.5 T, 11.6 T, 11.7 T, 11.8 T, 11.9 T, 12.0 T, 12.1 T, 12.2 T, 12.3 T, 12.4 T, 12.5 T, 12.6 T, 12.7 T, 12.8 T, 12.9 T, 13.0 T, 13.1 T, 13.2 T, 13.3 T, 13.4 T, 13.5 T, 13.6 T, 13.7 T, 13.8 T, 13.9 T, 14.0 T, 14.1 T, 14.2 T, 14.3 T, 14.4 T, 14.5 T, 14.6 T, 14.7 T, 14.8 T, 14.9 T, 15.0 T, 15.1 T, 15.2 T, 15.3 T, 15.4 T, 15.5 T, 15.6 T, 15.7 T, 15.8 T, 15.9 T, 16.0 T, 16.1 T, 16.2 T, 16.3 T, 16.4 T, 16.5 T, 16.6 T, 16.7 T, 16.8 T, 16.9 T, 17.0 T, 17.1 T, 17.2 T, 17.3 T, 17.4 T, 17.5 T, 17.6 T, 17.7 T, 17.8 T, 17.9 T, 18.0 T, 18.1 T, 18.2 T, 18.3 T, 18.4 T, 18.5 T, 18.6 T, 18.7 T, 18.8 T, 18.9 T, 19.0 T, 19.1 T, 19.2 T, 19.3 T, 19.4 T, 19.5 T, 19.6 T, 19.7 T, 19.8 T, 19.9 T, 20.0 T, 20.1 T, 20.2 T, 20.3 T, 20.4 T, 20.5 T, 20.6 T, 20.7 T, 20.8 T, 20.9 T, or more. Furthermore, a main coil may be used to generate magnetic fields that are within the range of 4 T to 20 T (or more) that are not specifically listed above. In some implementations, the currents through the active return coils and the main coils have the same (or about the same (e.g., within 10% difference)) magnitude. In some implementations, the currents through the active return coils and the main coils have different magnitudes.

In some implementations, each main coil is superconducting and made of niobium-3 tin ($Nb_3Sn$) and each active return coil is superconducting and made of niobium-titanium. However, in other implementations, each main coil and each return coil may be made of the same, different, and/or other materials than those noted above.

In some implementations, the same (e.g., a single) power supply may be used to generate current for both the main coil(s) in the magnet and the active return coil(s). This enables the current through all coils to ramp appropriately, and may be useful in example particle therapy systems.

The active return system described herein may be used in a single particle accelerator, and any two or more of the features thereof described herein may be combined in a single particle accelerator. The particle accelerator may be used in any type of medical or non-medical application. An example of a particle therapy system in which a superconducting magnet having the active return system described herein may be used is provided below.

Figure 3:
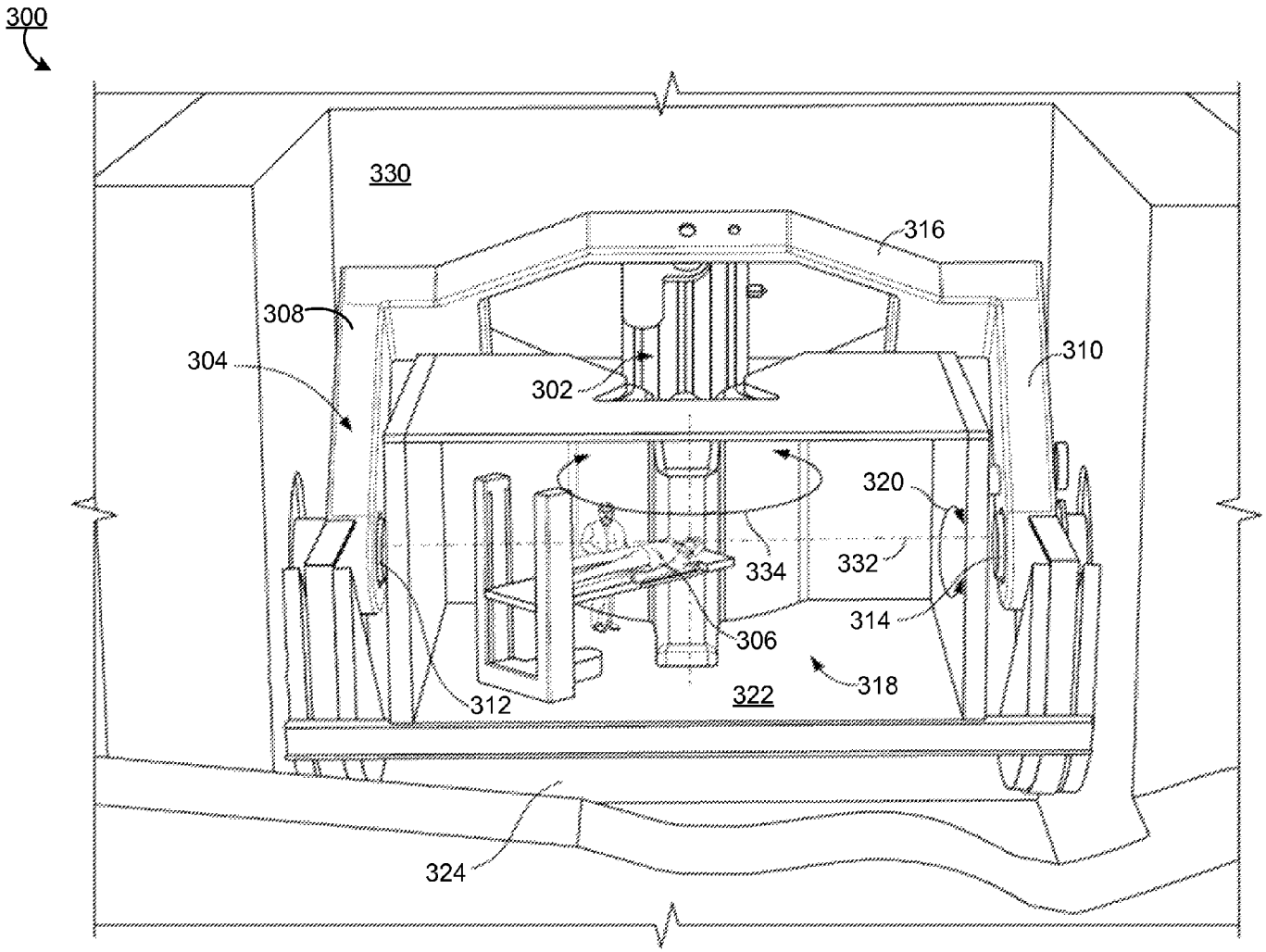
FIG. 3 is a front view of an example particle therapy system.

Referring to FIG. 3, a charged particle radiation therapy system 300 includes a beam-producing particle accelerator 302 having a weight and size small enough to permit it to be mounted on a rotating gantry 304 with its output directed straight (that is, essentially directly) from the accelerator housing toward a patient 306. In some implementations, the weight of the particle accelerator may be less than, or about equal to, one of the following weights: 20 tons, 19 tons, 18 tons, 17 tons, 16 tons, 15 tons, 14 tons, 14 tons, 13 tons, 12 tons, 11 tons, 10 tons, 9 tons, 8 tons, 7 tons, 6 tons, 5 tons, or 4 tons. However, the particle accelerator may have any appropriate weight.

In some implementations, the steel gantry has two legs 308, 310 mounted for rotation on two respective bearings 312, 314 that lie on opposite sides of the patient. The accelerator is supported by a steel truss 316 that is long enough to span a treatment area 318 in which the patient lies (e.g., twice as long as a tall person, to permit the person to be rotated fully within the space with any desired target area of the patient remaining in the line of the beam) and is attached stably at both ends to the rotating legs of the gantry.

In some examples, the rotation of the gantry is limited to a range 320 of less than 360 degrees, e.g., about 180 degrees, to permit a floor 322 to extend from a wall of the vault 324 that houses the therapy system into the patient treatment area. The limited rotation range of the gantry also reduces the required thickness of some of the walls (which are not directly aligned with the beam, e.g., wall 330), which provide radiation shielding of people outside the treatment area. A range of 180 degrees of gantry rotation is enough to cover all treatment approach angles, but providing a larger range of travel can be useful. For example the range of rotation may be between 180 and 330 degrees and still provide clearance for the therapy floor space. Angles of rotation other than these may be used.

The horizontal rotational axis 332 of the gantry may be located nominally one meter above the floor where the patient and therapist interact with the therapy system. This floor may be positioned about three meters above the bottom floor of the therapy system shielded vault. The accelerator can swing under the raised floor for delivery of treatment beams from below the rotational axis. The patient couch moves and rotates in a substantially horizontal plane parallel to the rotational axis of the gantry. The couch can rotate through a range 334 of about 270 degrees in the horizontal plane with this configuration. This combination of gantry and patient rotational ranges and degrees of freedom allow the therapist to select virtually any approach angle for the beam. If needed, the patient can be placed on the couch in the opposite orientation and then all possible angles can be used.

In some implementations, the accelerator uses a synchrocyclotron configuration having a very high magnetic field superconducting electromagnetic structure. Because the bend radius of a charged particle of a given kinetic energy is reduced in direct proportion to an increase in the magnetic field applied to it, the very high magnetic field superconducting magnetic structure permits the accelerator to be made smaller and lighter. The synchrocyclotron uses a magnetic field that is uniform in rotation angle and falls off in strength with increasing radius. Such a field shape can be achieved regardless of the magnitude of the magnetic field, so in theory there is no upper limit to the magnetic field strength (and therefore the resulting particle energy at a fixed radius) that can be used in a synchrocyclotron.

In the example implementation shown in FIG. 3, the superconducting synchrocyclotron 302 operates with a peak magnetic field in a pole gap of the synchrocyclotron of 8.8 Tesla. The synchrocyclotron produces a beam of protons having an energy of 250 MeV. In some implementations, the magnetic field strength may be in the range of 4 T to 20 T and the proton energy may be in the range of 150 to 300 MeV. In some implementations, the magnetic field strength of the active return coils may be in the range of 2.5 T to 12 T.

The radiation therapy system described in this example is used for proton radiation therapy, but the same principles and details can be applied in analogous systems for use in heavy ion (ion) treatment systems.

An example synchrocyclotron includes a magnet system that contains a particle source, a radio frequency (RF) drive system, and a beam extraction system. In some implementations, types of particle accelerators may be used in which one or more of these elements is external to the accelerator.

Figure 4:
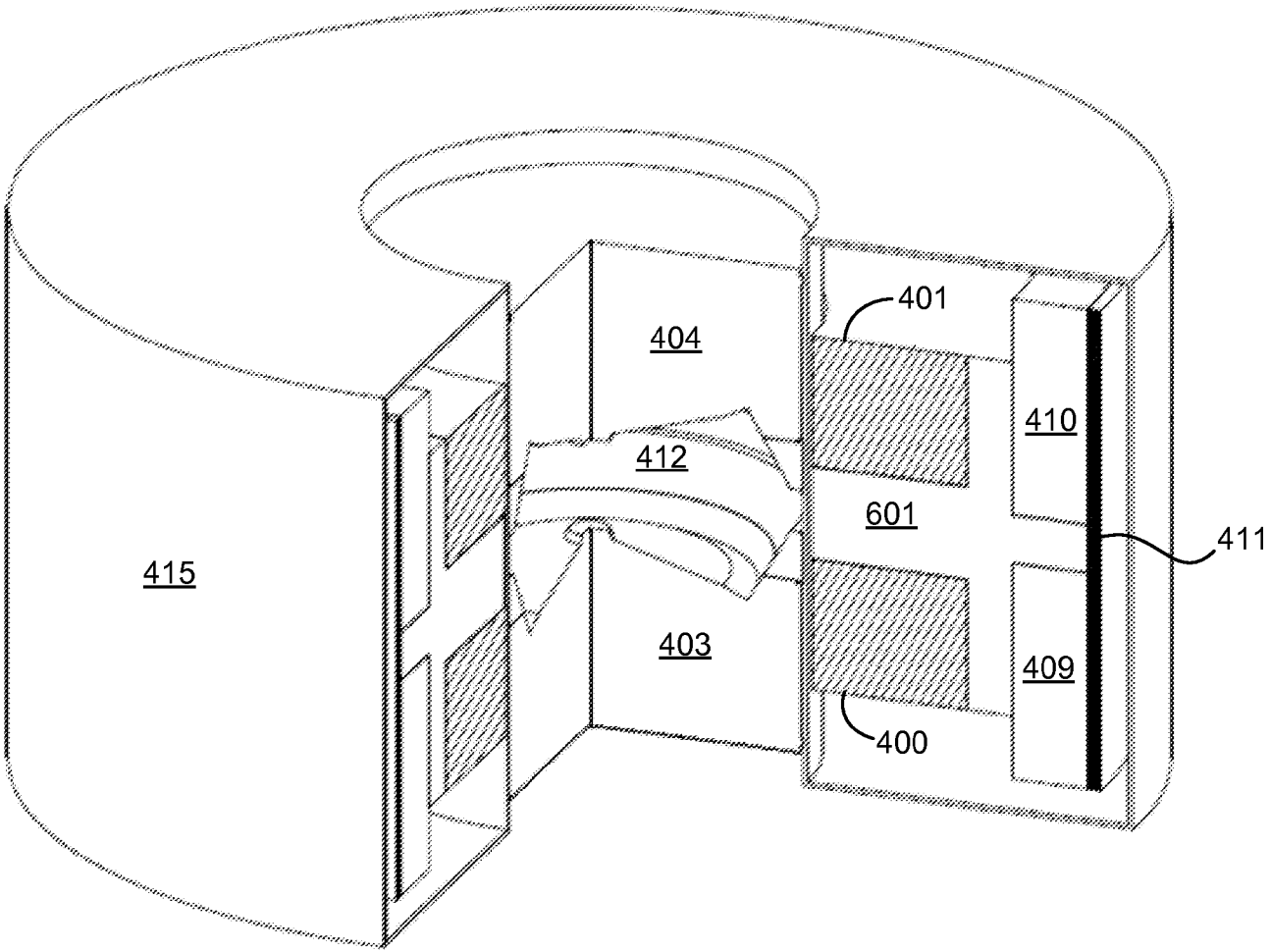
FIG. 4 is a perspective, cut-away view of example components of a superconducting magnet with active return coils.
Figure 5:
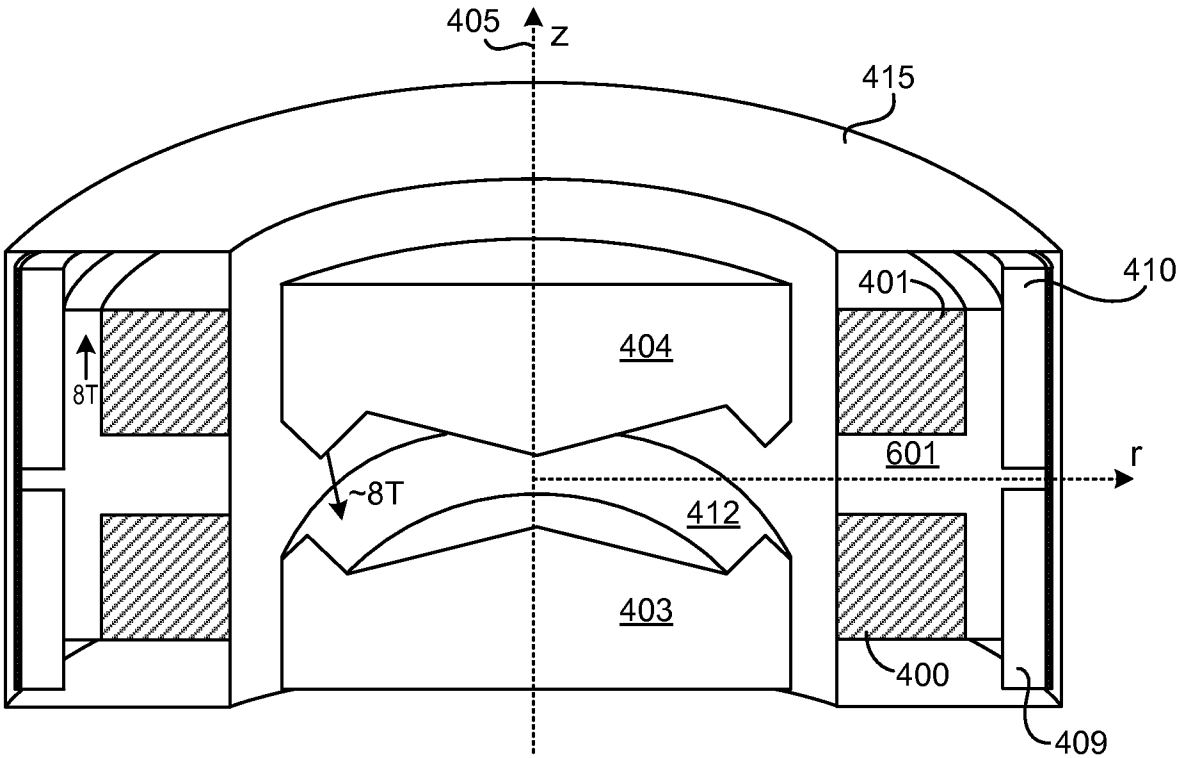
FIG. 5 is a front, cut-away view of example components of a superconducting magnet with active return coils.

Referring to FIGS. 4 and 5, the magnetic field established by the magnet system has a shape appropriate to maintain focus of a contained proton beam using a combination of a split pair of annular superconducting coils 400, 401 and a pair of shaped ferromagnetic (e.g., low carbon steel) pole faces 403, 404.

Figure 7:
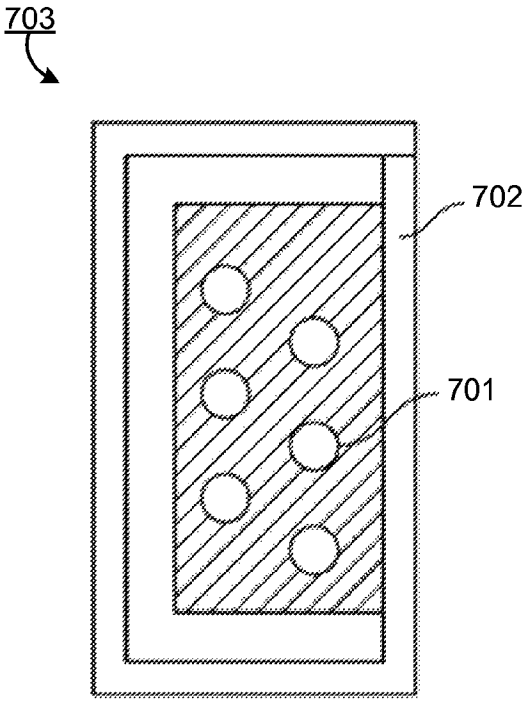
FIG. 7 is a cross-sectional view of an example cable-in-channel composite conductor.
Figure 6:
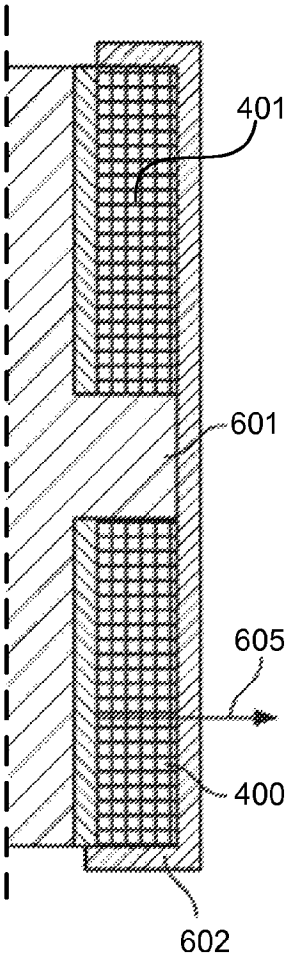
FIG. 6 is a cross-sectional view of part of an example support structure and example superconducting coil windings.

The two superconducting magnet coils are centered on a common axis 405 and are spaced apart along the axis. Referring to FIGS. 6 and 7, the coils may be formed by of $Nb_3Sn$-based superconducting 0.8 mm diameter strands 701 (that initially comprise a niobium-tin core surrounded by a copper sheath) deployed in a twisted cable-in-channel conductor geometry. After seven individual strands are cabled together, they are heated to cause a reaction that forms the final (brittle) superconducting material of the wire. After the material has been reacted, the wires are soldered into the copper channel (outer dimensions 3.18×2.54 mm and inner dimensions 2.08×2.08 mm) and covered with insulation 702 (in this example, a woven fiberglass material). The copper channel containing the wires 703 is then wound in a coil having a rectangular cross-section of 8.55 cm×19.02 cm, having 26 layers and 49 turns per layer. The wound coil is then vacuum impregnated with an epoxy compound. The finished coils 400, 401 are mounted on an annular stainless steel reverse support structure 601. Heater blankets 602 are placed at intervals in the layers of the windings to protect the assembly in the event of a magnet quench.

The geometry of the main coils is maintained by support structure 601, which exerts a restorative force 605 that works against the distorting (e.g., expansion) force produced when the coils are energized. The coil positions may be maintained relative to the magnet pole piece and cryostat using a set of tension links (not shown) that connect the support structure to a cryostat cover (described below) that defines the perimeter of the cryostat.

The main superconducting coils are maintained at temperatures near absolute zero (e.g., about 4 degrees Kelvin) by enclosing the coil assembly (the coils and the support structure) inside an evacuated annular aluminum or stainless steel cryostatic chamber that provides at least some free space around the coil structure. In some implementations, the temperature near absolute zero is achieved and maintained using a cooling channel (not shown) containing liquid helium, which is formed inside the support structure, and which contains a thermal connection between the liquid helium in the channel and the corresponding superconducting coil. An example of a liquid helium cooling system of the type described above, and that may be used is described in U.S. patent application Ser. No. 13/148,000 (Begg et al.).

In FIGS. 4 and 5, the superconducting coils 400, 401 are mounted on the interior of support structure 601. In some implementations, support structure 601 may be made of structural steel, such as stainless steel, or carbon fiber. Active return coils 409, 410 are mounted on the exterior of support structure 601, as shown in FIGS. 4 and 5. A banding ring 411, which may be made, e.g., of carbon fiber or other appropriate material, is mounted around active return coils 409, 410 to hold them in place during magnet operation and thereby maintain their shape (e.g., in response to expansive force resulting from operation). Each active return coil 409, 410 is concentric with respect to its corresponding main coil 400, 401.

The active return coils may be made of superconducting material, such as niobium-titanium or other appropriate materials. The active return coils may be constructed in the same manner as the main coils. In some implementations, the active return coils may be maintained at superconducting temperatures in the same manner as the main superconducting coils, e.g., by conducting heat to a liquid helium cooling channel (not shown in FIGS. 4 and 5). In some implementations, the active return coils may be cooled using other techniques.

Support structure 601, including the main and active return coils, surrounds ferromagnetic (e.g., iron) pole pieces 403, 404, which together define a cavity 412. An ion source is at about the center of cavity 412 to provide the particles for acceleration. In other examples, the ion source may be external to the accelerator. Particles are accelerated in cavity 412 and output as a beam to an extraction channel (not shown) inside the magnet assembly. From the extraction channel, the beam is output essentially directly to the patient.

The support structure, the pole pieces, the main coils and the active return coils (along with other structure, not described herein) are housed in a cryostat cover 415 which, among other things, maintains the temperature of the magnet assembly. Cryostat cover 415 may be may be made of stainless steel, carbon, or other appropriate, relatively lightweight material. Accordingly, as indicated above, in some implementations, a particle accelerator containing the example magnet assembly may have a weight that is less than, or about equal to, one of the following weights: 20 tons, 19 tons, 18 tons, 17 tons, 16 tons, 15 tons, 14 tons, 14 tons, 13 tons, 12 tons, 11 tons, 10 tons, 9 tons, 8 tons, 7 tons, 6 tons, 5 tons, or 4 tons. The actual weight of the particle accelerator and of the magnet assembly may depend on a variety of factors, and is not limited to the example weights provided here.

Figure 8:
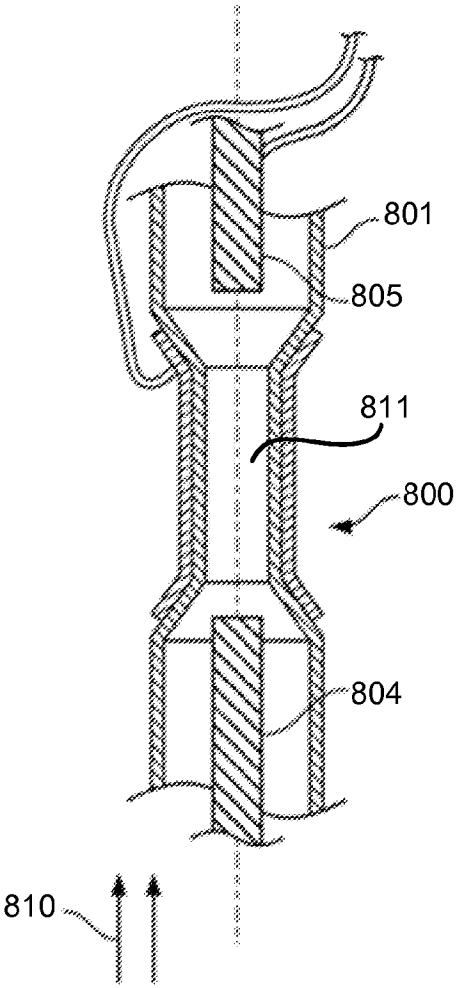
FIG. 8 is a cross-sectional view of an example ion source.

Examples of particle sources that may be included in cavity 412 are as follows. Referring to FIG. 8, in some implementations, a particle source 800 has a Penning ion gauge geometry. The particle source may be as described below, or the particle source may be of the type described in U.S. patent application Ser. No. 11/948,662 incorporated herein by reference. U.S. patent application Ser. No. 11/948,662 describes a particle source in which a tube containing plasma is interrupted at at least a portion of its mid-plane. The remaining features of the particle source are similar to those described with respect to FIG. 8.

Particle source 800 is fed from a supply of hydrogen through a gas line and a tube that delivers gaseous hydrogen. Electric cables carry an electric current from a current source to stimulate electron discharge from cathodes 804, 805 that are aligned with the magnetic field, 810.

In this example, the discharged electrons ionize the gas exiting through a small hole from tube 811 to create a supply of positive ions (protons) for acceleration by one semicircular (dee-shaped) radio-frequency plate 900 that spans half of the space enclosed by the magnet structure and one dummy dee plate 902. In the case of an interrupted particle source (an example of which is described in U.S. patent application Ser. No. 11/948,662), all (or a substantial part) of the tube containing plasma is removed at the acceleration region, thereby allowing ions to be more rapidly accelerated in a relatively high magnetic field.

Figure 9:
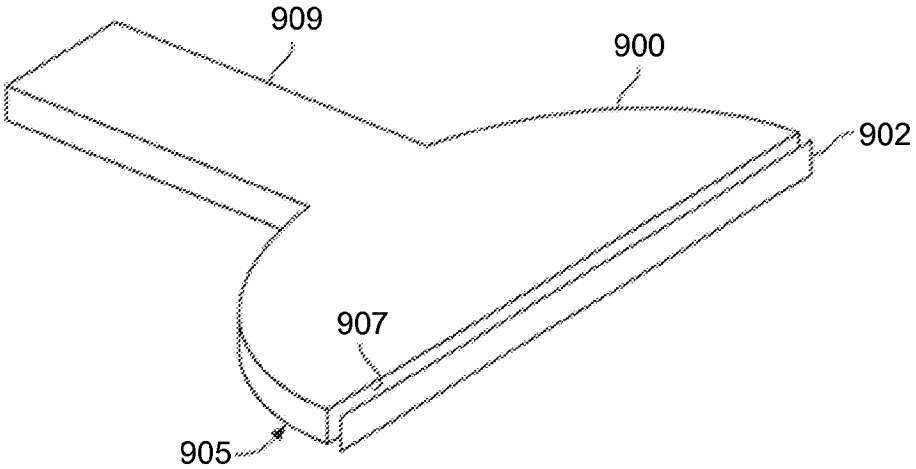
FIG. 9 is a perspective view of an example dee plate and dummy dee.

As shown in FIG. 9, the dee plate 900 is a hollow metal structure that has two semicircular surfaces 903, 905 that enclose a space 907 in which the protons are accelerated during half of their rotation around the space enclosed by the magnet structure. A duct 909 opening into the space 907 extends through the pole piece to an external location from which a vacuum pump can be attached to evacuate the space 907 and the rest of the space within a vacuum chamber in which the acceleration takes place. The dummy dee 902 comprises a rectangular metal ring that is spaced near to the exposed rim of the dee plate. The dummy dee is grounded to the vacuum chamber and pole piece. The dee plate 900 is driven by a radio-frequency signal that is applied at the end of a radio-frequency transmission line to impart an electric field in the space 907. The radio frequency electric field is made to vary in time as the accelerated particle beam increases in distance from the geometric center. Examples of radio frequency waveform generators that are useful for this purpose are described in U.S. patent application Ser. No. 11/187,633, titled "A Programmable Radio Frequency Waveform Generator for a Synchrocyclotron," filed Jul. 21, 2005, and in U.S. Provisional Application No. 60/590,089, same title, filed on Jul. 21, 2004, both of which are incorporated herein by reference. The radio frequency electric field may be controlled in the manner described in U.S. patent application Ser. No. 11/948,359, entitled "Matching A Resonant Frequency Of A Resonant Cavity To A Frequency Of An Input Voltage", the contents of which are incorporated herein by reference.

For the beam emerging from the centrally-located particle source to clear the particle source structure as it begins to spiral outward, a large voltage difference is applied across the radio frequency plates. 20,000 Volts may be applied across the radio frequency plates. In some versions from 8,000 to 20,000 Volts may be applied across the radio frequency plates. To reduce the power required to drive this large voltage, the magnet structure may be arranged to reduce the capacitance between the radio frequency plates and ground. This may be done by forming holes with sufficient clearance from the radio frequency structures through the outer pole piece and the cryostat housing and making sufficient space between the magnet pole faces.

The high voltage alternating potential that drives the dee plate has a frequency that is swept downward during the accelerating cycle to account for the increasing relativistic mass of the protons and the decreasing magnetic field. The dummy dee does not require a hollow semi-cylindrical structure as it is at ground potential along with the vacuum chamber walls. Other plate arrangements could be used, such as more than one pair of accelerating electrodes driven with different electrical phases or multiples of the fundamental frequency. The RF structure can be tuned to keep its Q high during the radio frequency sweep by using, for example, a rotating capacitor having intermeshing rotating and stationary blades. During each meshing of the blades, the capacitance increases, thus lowering the resonant frequency of the RF structure. The blades can be shaped to create a precise frequency sweep required. A drive motor for the rotating condenser can be phase locked to the RF generator for precise control. One bunch of particles is accelerated during each meshing of the blades of the rotating condenser.

The vacuum chamber (e.g., cavity 412) in which the acceleration occurs is a generally cylindrical container that is thinner in the center and thicker at the rim. The vacuum chamber encloses the RF plates and the particle source and is evacuated by the vacuum pump. Maintaining a high vacuum reduces the chances that accelerating ions will be lost to collisions with gas molecules and enables the RF voltage to be kept at a higher level without arcing to ground.

Protons traverse a generally spiral orbital path beginning at the particle source. In half of each loop of the spiral path, the protons gain energy as they pass through the RF electric field in space 907. As the ions gain energy, the radius of the central orbit of each successive loop of their spiral path is larger than the prior loop until the loop radius reaches the maximum radius of the pole face. At that location a magnetic and electric field perturbation directs ions into an area where the magnetic field rapidly decreases, and the ions depart the area of the high magnetic field and are directed through an evacuated tube (which is part of the accelerator), referred to herein as the extraction channel, to exit the pole piece of the cyclotron. A magnetic regenerator may be used to change the magnetic field perturbation to direct the ions. The ions exiting the cyclotron will tend to disperse as they enter the area of markedly decreased magnetic field that exists in the room around the cyclotron. Beam shaping elements in the extraction channel redirect the ions so that they stay in a straight beam of limited spatial extent.

As the beam exits the extraction channel it may be passed through a beam formation system that can be programmably controlled to create a desired combination of scattering angle and range modulation for the beam. Examples of beam forming systems useful for that purpose are described in U.S. patent application Ser. No. 10/949,734, titled "A Programmable Particle Scatterer for Radiation Therapy Beam Formation", filed Sep. 24, 2004, and U.S. Provisional Application No. 60/590,088, filed Jul. 21, 2005, both of which are incorporated herein by reference. The beam formation system may be used in conjunction with an inner gantry to direct a beam to the patient.

During operation, plates absorb energy from the applied radio frequency field as a result of conductive resistance along the surfaces of the plates. This energy appears as heat and may be removed from the plates using water cooling lines that release the heat in a heat exchanger.

Stray magnetic fields exiting from the cyclotron are limited by active return coils 409, 410. Accordingly, separate magnetic shielding is typically not required. However, in some implementations, a separate magnetic shield may be used. The separate magnetic shield may include a layer ferromagnetic material (e.g., steel or iron) that encloses the cryostat and is separated by a space.

As mentioned, the gantry allows the synchrocyclotron to be rotated about the horizontal rotational axis 332. The gantry is driven to rotate by an electric motor mounted to one or both of the gantry legs and connected to the bearing housings by drive gears. The rotational position of the gantry is derived from signals provided by shaft angle encoders incorporated into the gantry drive motors and the drive gears.

Figure 10:
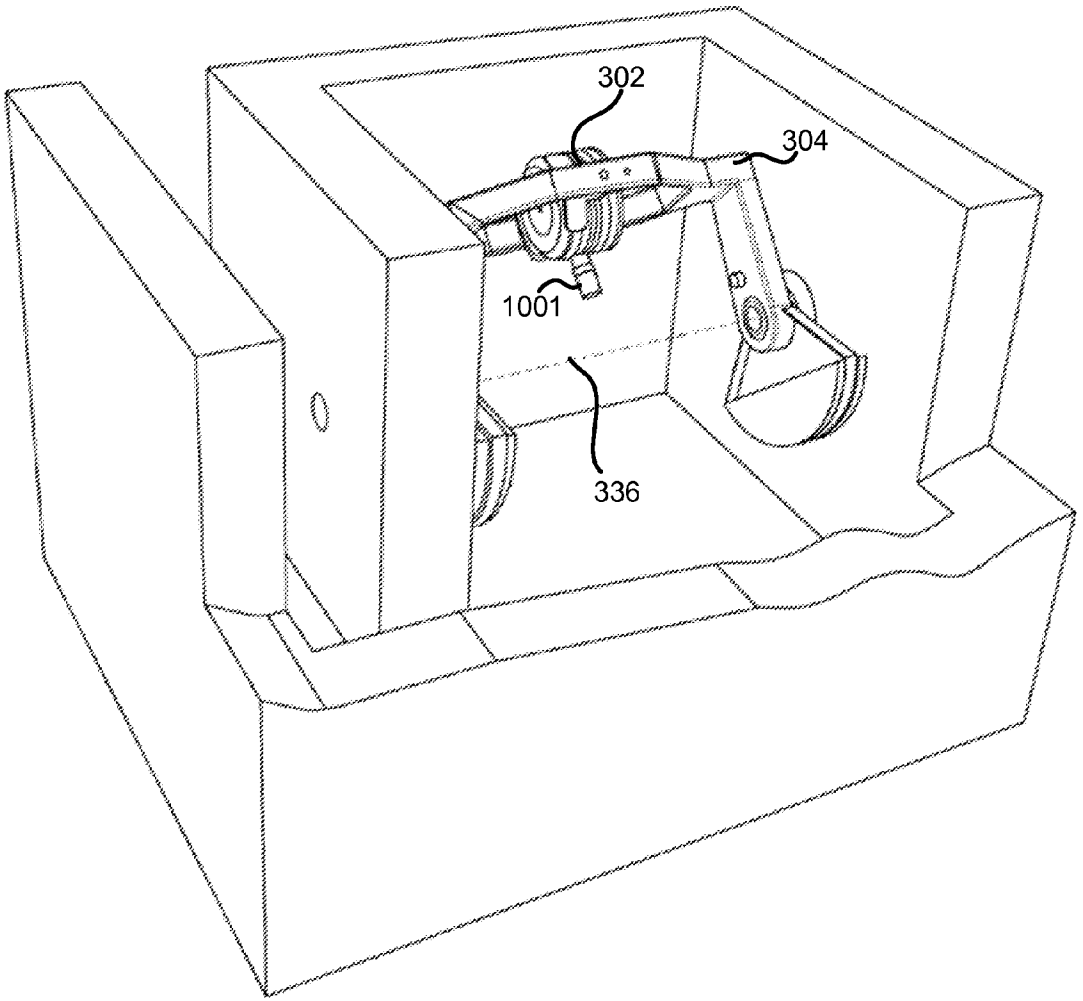
FIG. 10 is a perspective view of an example vault containing an example gantry and particle accelerator.

Referring to FIG. 10, at the location at which the ion beam exits synchrocyclotron 302, a beam formation system 1001 acts on the ion beam to give it properties suitable for patient treatment. For example, the beam may be spread and its depth of penetration varied to provide uniform radiation across a given target volume. The beam formation may can include passive scattering elements as well as active scanning elements.

All of the active systems of the synchrocyclotron (current driven superconducting coils, RF-driven plates, vacuum pumps for the vacuum acceleration chamber and for a superconducting coil cooling chamber, current driven particle source, hydrogen gas source, and RF plate coolers, for example), may be controlled by appropriate synchrocyclotron control electronics (not shown), which may include, e.g., one or more computers programmed with appropriate programs (e.g., executable instructions) to effect control.

The control of the gantry, the patient support, the active beam shaping elements, and the synchrocyclotron to perform a therapy session may also be achieved by appropriate therapy control electronics (not shown).

Further details regarding the foregoing system may be found in U.S. Pat. No. 7,728,311, filed on Nov. 16, 2006 and entitled "Charged Particle Radiation Therapy", and in U.S. patent application Ser. No. 12/275,103, filed on Nov. 20, 2008 and entitled "Inner Gantry". The contents of U.S. Pat. No. 7,728,311 and in U.S. patent application Ser. No. 12/275,103 are hereby incorporated by reference into this disclosure.

Any two more of the foregoing implementations may be used in an appropriate combination in an appropriate particle accelerator (e.g., a synchrocyclotron). Likewise, individual features of any two more of the foregoing implementations may be used in an appropriate combination.

Elements of different implementations described herein may be combined to form other implementations not specifically set forth above. Elements may be left out of the processes, systems, apparatus, etc., described herein without adversely affecting their operation. Various separate elements may be combined into one or more individual elements to perform the functions described herein.

The example implementations described herein are not limited to use with a particle therapy system or to use with the example particle therapy systems described herein. Rather, the example implementations can be used in any appropriate system that directs accelerated particles to an output.

Additional information concerning the design of the particle accelerator described herein can be found in U.S. Provisional Application No. 60/760,788, entitled "High-Field Superconducting Synchrocyclotron" and filed Jan. 20, 2006; U.S. patent application Ser. No. 11/463,402, entitled "Magnet Structure For Particle Acceleration" and filed Aug. 9, 2006; and U.S. Provisional Application No. 60/850,565, entitled "Cryogenic Vacuum Break Pneumatic Thermal Coupler" and filed Oct. 10, 2006, all of which are incorporated herein by reference as if set forth in full.

The following applications, which were filed on Sep. 28, 2012, are incorporated by reference into the subject application as if set forth herein in full: the U.S. Provisional Application entitled "CONTROLLING INTENSITY OF A PARTICLE BEAM" (Application No. 61/707,466), the U.S. Provisional Application entitled "ADJUSTING ENERGY OF A PARTICLE BEAM" (Application No. 61/707,515), the U.S. Provisional Application entitled "ADJUSTING COIL POSITION" (Application No. 61/707,548), the U.S. Provisional Application entitled "FOCUSING A PARTICLE BEAM USING MAGNETIC FIELD FLUTTER" (Application No. 61/707,572), the U.S. Provisional Application entitled "MAGNETIC FIELD REGENERATOR" (Application No. 61/707,590), the U.S. Provisional Application entitled "FOCUSING A PARTICLE BEAM" (Application No. 61/707,704), the U.S. Provisional Application entitled "CONTROLLING PARTICLE THERAPY (Application No. 61/707,624), and the U.S. Provisional Application entitled "CONTROL SYSTEM FOR A PARTICLE ACCELERATOR" (Application No. 61/707,645).

The following are also incorporated by reference into the subject application as if set forth herein in full: U.S. Pat. No. 7,728,311 which issued on Jun. 1, 2010, U.S. patent application Ser. No. 11/948,359 which was filed on Nov. 30, 2007, U.S. patent application Ser. No. 12/275,103 which was filed on Nov. 20, 2008, U.S. patent application Ser. No. 11/948,662 which was filed on Nov. 30, 2007, U.S. Provisional Application No. 60/991,454 which was filed on Nov. 30, 2007, U.S. Pat. No. 8,003,964 which issued on Aug. 23, 2011, U.S. Pat. No. 7,208,748 which issued on Apr. 24, 2007, U.S. Pat. No. 7,402,963 which issued on Jul. 22, 2008, and U.S. patent application Ser. No. 11/937,573 filed on Nov. 9, 2007.

Any features of the subject application may be combined with one or more appropriate features of the following: the U.S. Provisional Application entitled "CONTROLLING INTENSITY OF A PARTICLE BEAM" (Application No. 61/707,466), the U.S. Provisional Application entitled "ADJUSTING ENERGY OF A PARTICLE BEAM" (Application No. 61/707,515), the U.S. Provisional Application entitled "ADJUSTING COIL POSITION" (Application No. 61/707,548), the U.S. Provisional Application entitled "FOCUSING A PARTICLE BEAM USING MAGNETIC FIELD FLUTTER" (Application No. 61/707,572), the U.S. Provisional Application entitled "MAGNETIC FIELD REGENERATOR" (Application No. 61/707,590), the U.S. Provisional Application entitled "FOCUSING A PARTICLE BEAM" (Application No. 61/707,704), the U.S. Provisional Application entitled "CONTROLLING PARTICLE THERAPY (Application No. 61/707,624), and the U.S. Provisional Application entitled "CONTROL SYSTEM FOR A PARTICLE ACCELERATOR" (Application No. 61/707,645), U.S. Pat. No. 7,728,311 which issued on Jun. 1, 2010, U.S. patent application Ser. No. 11/948,359 which was filed on Nov. 30, 2007, U.S. patent application Ser. No. 12/275,103 which was filed on Nov. 20, 2008, U.S. patent application Ser. No. 11/948,662 which was filed on Nov. 30, 2007, U.S. Provisional Application No. 60/991,454 which was filed on Nov. 30, 2007, U.S. Pat. No. 8,003,964 which issued on Aug. 23, 2011, U.S. Pat. No. 7,208,748 which issued on Apr. 24, 2007, U.S. Pat. No. 7,402,963 which issued on Jul. 22, 2008, U.S. patent application Ser. No. 13/148,000 filed Feb. 9, 2010, and U.S. patent application Ser. No. 11/937,573 filed on Nov. 9, 2007.

Other implementations not specifically described herein are also within the scope of the following claims.

What is claimed is:

1. A particle accelerator comprising:

a magnet to generate a magnetic field, the magnet comprising first superconducting coils to pass current in a first direction to thereby generate the first magnetic field, the first magnetic field being at least 4 Tesla (T);

an active return system comprising second superconducting coils, each of the second superconducting coils surrounding, and being concentric with, a corresponding first superconducting coil, the second superconducting coils for passing current in a second direction that is opposite to the first direction to thereby generate a second magnetic field having a magnetic field of at least 2.5 T, the second magnetic field having a polarity that is opposite to a polarity of the first magnetic field; and a single structure on which at least one first superconducting coil and corresponding second superconducting coil are mounted.

2. The particle accelerator of claim 1, further comprising:

a power supply to provide current to both the first superconducting coils and to the second superconducting coils.

3. The particle accelerator of claim 1, wherein the first superconducting coils and the second superconducting coils are all mounted on the single structure.

4. The particle accelerator of claim 3, wherein the first superconducting coils are mounted on an interior of the single structure and the second superconducting coils are mounted on an exterior of the single structure such that the second superconducting coils are separated from the first superconducting coils by at least part of the single structure.

5. The particle accelerator of claim 3, further comprising:

a banding ring around at least one of the second superconducting coils.

6. The particle accelerator of claim 3, wherein the single structure comprises at least one of stainless steel and carbon fiber.

7. The particle accelerator of claim 1, further comprising:

magnetic pole pieces defining the cavity, the single structure being around at least part of the magnetic pole pieces.

8. The particle accelerator of claim 7, further comprising:

a cryostat cover around at least part of the single structure and at least part of the magnetic pole pieces, the cryostat cover comprising a non-ferromagnetic material.

9. The particle accelerator of claim 1, which weighs less than 15 tons.

10. The particle accelerator of claim 1, which weighs less than 10 tons.

11. A proton therapy system comprising:

the particle accelerator of claim 1; and a gantry on which the particle accelerator is mounted, the gantry being rotatable relative to a patient position;

wherein the proton therapy system is configured to output protons essentially directly from the particle accelerator to the patient position.

12. The proton therapy system of claim 11, wherein the particle accelerator comprises a synchrocyclotron.

13. The proton therapy system of claim 11, wherein the particle accelerator comprises:

a particle source to provide ionized plasma to a cavity containing the first magnetic field; and a voltage source to provide voltage to accelerate a beam comprised of pulses of ionized plasma towards an exit.

14. A particle accelerator comprising:

a voltage source to provide a radio frequency (RF) voltage to a cavity to accelerate particles to produce a particle beam, the cavity having a first magnetic field for causing particles accelerated from the plasma column to move orbitally within the cavity, the RF voltage being controllable to vary in time as the particle beam increases in distance from the plasma column;

a magnet to generate the first magnetic field in the cavity, the magnet comprising first superconducting coils to pass current in a first direction to thereby generate the first magnetic field;

an active return system comprising second superconducting coils, each of the second superconducting coils surrounding, and being concentric with, a corresponding first superconducting coil, the second superconducting coils for passing current in a second direction that is opposite to the first direction to thereby generate a second magnetic field having a magnetic field of at least 2.5 Tesla (T), the second magnetic field having a polarity that is opposite to a polarity of the first magnetic field; and a single structure on which at least one first superconducting coil and corresponding second superconducting coil are mounted.

15. The particle accelerator of claim 14, wherein the first magnetic field is least 4 T.

16. The particle accelerator of claim 15, wherein the second magnetic field is at between 2.5 T and 12 T.

17. The particle accelerator of claim 14, wherein the first magnetic field is between 4 T and 20 T and the second magnetic field is between 2.5 T and 12 T.

18. The particle accelerator of claim 14, further comprising:

a single power supply to provide current to both the first superconducting coils and to the second superconducting coils.

19. The particle accelerator of claim 14, wherein the first superconducting coils and the second superconducting coils are all mounted on the single structure.

20. The particle accelerator of claim 19, wherein the first superconducting coils are mounted on an interior of the single structure and the second superconducting coils are mounted on an exterior of the single structure such that the second superconducting coils are separated from the first superconducting coils by at least part of the single structure.

21. The particle accelerator of claim 19, further comprising:

a banding ring around at least one of the second superconducting coils.

22. The particle accelerator of claim 19, wherein the single structure comprises at least one of stainless steel and carbon fiber.

23. The particle accelerator of claim 14, further comprising:

magnetic pole pieces defining the cavity, the single structure being around at least part of the magnetic pole pieces.

24. The particle accelerator of claim 23, further comprising:

a cryostat cover around at least part of the single structure and at least part of the magnetic pole pieces, the cryostat cover comprising a non-ferromagnetic material.

25. The particle accelerator of claim 14, which weighs less than 15 tons.

26. The particle accelerator of claim 14, which weighs less than 10 tons.

27. A proton therapy system comprising:

the particle accelerator of claim 14; and a gantry on which the particle accelerator is mounted, the gantry being rotatable relative to a patient position;

wherein the proton therapy system is configured to output protons essentially directly from the particle accelerator to the patient position.

* * * * *